US006869659B2

(12) United States Patent
Shepard et al.

(10) Patent No.: US 6,869,659 B2
(45) **Date of Patent: *Mar. 22, 2005**

(54) FASTENER LOOP MATERIAL, ITS MANUFACTURE, AND PRODUCTS INCORPORATING THE MATERIAL

(75) Inventors: William H. Shepard, Amherst, NH (US); Paul R. Erickson, New Boston, NH (US); Michael J. Onderko, Pelham, NH (US)

(73) Assignee: Velcro Industries B.V., Curacao (AN)

( * ) Notice: Subject to any disclaimer, the term of this patent is extended or adjusted under 35 U.S.C. 154(b) by 178 days.

This patent is subject to a terminal disclaimer.

(21) Appl. No.: 10/125,679

(22) Filed: Apr. 18, 2002

(65) Prior Publication Data

US 2002/0160143 A1 Oct. 31, 2002

Related U.S. Application Data

(63) Continuation-in-part of application No. 09/996,618, filed on Nov. 27, 2001, now Pat. No. 6,783,834, which is a continuation of application No. 09/262,159, filed on Mar. 3, 1999, now Pat. No. 6,329,046, which is a continuation-in-part of application No. 08/922,292, filed on Sep. 3, 1997, now Pat. No. 6,342,285.

(30) Foreign Application Priority Data

Sep. 3, 1998 (WO) ..... PCT/US98/18401

(51) Int. Cl.[7] ..... B32B 5/08; D04H 11/00; D04H 11/08

(52) U.S. Cl. ..... 428/92; 428/89; 428/96; 428/99; 428/100; 442/104; 442/344; 442/347; 442/370; 442/374; 442/394; 442/402

(58) Field of Search ..... 428/99, 100, 88, 428/89, 92, 96; 442/340, 344, 347, 370, 374, 394, 402, 103, 104, 109

(56) References Cited

U.S. PATENT DOCUMENTS

| | | | |
|---|---|---|---|
| 2,913,803 | A | 11/1959 | Dodds |
| 3,152,381 | A | 10/1964 | Priester, Jr. et al. |
| 3,341,386 | A | 9/1967 | White et al. |
| 3,347,735 | A | 10/1967 | Dildilian |
| 3,674,618 | A | 7/1972 | Spann |
| 3,694,867 | A | 10/1972 | Stumpf |

(List continued on next page.)

FOREIGN PATENT DOCUMENTS

| | | |
|---|---|---|
| EP | 0 341 993 | 11/1989 |
| EP | 0 482 749 A1 | 4/1992 |
| EP | 0 604 731 A1 | 7/1994 |
| EP | 0 605 013 A1 | 7/1994 |
| EP | 0 765 616 A1 | 4/1997 |

(List continued on next page.)

OTHER PUBLICATIONS

Assoc. of the Nonwoven Fabrics Industry, "The Needlepunch Primer", INDA pp. 1–29 (1995).

Foster, "Needlepunching A Unique Sector," FW: Nonwovens Manufacturing, pp. 1–6 (1996).

Velcro Brochure "Nonwoven & Knitted Loops" Velcro USA Inc. Product Information Guide 3/01.

*Primary Examiner*—Cheryl A. Juska
(74) *Attorney, Agent, or Firm*—Fish & Richardson P.C.

(57) ABSTRACT

Lightweight, non-woven loop products for hook-and-loop fastening are disclosed, as are methods for making them and end products employing them. The products are non-woven webs of entangled fibers of substantial tenacity, the fibers forming both a sheet-form web body and hook-engageable, free-standing loops extending from the web body. The product is stretched and stabilized to produce spaced-apart loop clusters extending from a very thin web of taut fibers. In some embodiments, the fibers include low denier fibers and/or bicomponent fibers.

47 Claims, 8 Drawing Sheets

U.S. PATENT DOCUMENTS

| | | | | |
|---|---|---|---|---|
| 3,705,056 | A | 12/1972 | Stumpf | |
| 3,708,361 | A | 1/1973 | Stumpf | |
| 3,708,833 | A | 1/1973 | Ribich et al. | 24/204 |
| 3,720,578 | A | 3/1973 | Heling et al. | 162/116 |
| 3,756,907 | A | 9/1973 | Heling | 162/114 |
| 3,822,162 | A | 7/1974 | Stumpf | |
| 3,863,304 | A | 2/1975 | Brumlik | 24/204 |
| 4,116,892 | A | 9/1978 | Schwarz | 521/62 |
| 4,154,885 | A | 5/1979 | Tecl et al. | 428/198 |
| 4,154,889 | A | 5/1979 | Platt | |
| 4,223,059 | A | 9/1980 | Schwarz | 428/198 |
| 4,258,097 | A | 3/1981 | Benedyk | 428/224 |
| 4,295,251 | A | 10/1981 | Tatham et al. | |
| 4,320,167 | A | 3/1982 | Wishman | 428/89 |
| 4,363,845 | A | 12/1982 | Hartmann | 428/198 |
| 4,377,889 | A | 3/1983 | Tatham et al. | |
| 4,379,189 | A | 4/1983 | Platt | 428/89 |
| 4,389,442 | A | 6/1983 | Pickens, Jr. et al. | 428/92 |
| 4,391,866 | A | 7/1983 | Pickens, Jr. et al. | |
| 4,418,104 | A | 11/1983 | Kiyomura et al. | 428/15 |
| 4,424,250 | A | 1/1984 | Adams et al. | 428/198 |
| 4,446,189 | A | 5/1984 | Romanek | |
| 4,451,314 | A | 5/1984 | Knoke et al. | 156/148 |
| 4,451,315 | A | 5/1984 | Miyazaki | 156/220 |
| 4,490,425 | A | 12/1984 | Knoke et al. | 428/90 |
| 4,536,439 | A | 8/1985 | Forsten | |
| 4,600,605 | A | 7/1986 | Nakai et al. | 427/379 |
| 4,600,618 | A | 7/1986 | Raychok, Jr. et al. | 428/92 |
| 4,624,116 | A | 11/1986 | Rogers | 66/193 |
| 4,645,699 | A | 2/1987 | Neveu | 428/95 |
| 4,654,246 | A | 3/1987 | Provost et al. | 428/88 |
| 4,739,635 | A | 4/1988 | Conley et al. | 66/190 |
| 4,750,443 | A | 6/1988 | Blaustein et al. | |
| 4,761,318 | A | 8/1988 | Ott et al. | 428/85 |
| 4,806,300 | A | 2/1989 | Walton et al. | 264/288 |
| 4,931,343 | A | 6/1990 | Becker et al. | 428/95 |
| 4,973,326 | A | 11/1990 | Wood et al. | 604/391 |
| 4,981,749 | A | 1/1991 | Kubo et al. | 428/129 |
| 4,992,124 | A | 2/1991 | Kurihara et al. | |
| 5,032,122 | A | 7/1991 | Noel et al. | 604/391 |
| 5,066,289 | A | 11/1991 | Polski | |
| 5,144,730 | A | 9/1992 | Dilo | 28/109 |
| 5,151,320 | A | 9/1992 | Homonoff et al. | |
| 5,214,942 | A | 6/1993 | Peake, III et al. | 66/194 |
| 5,216,790 | A | 6/1993 | Eschenbach | |
| 5,256,231 | A | 10/1993 | Gorman et al. | |
| 5,267,453 | A | 12/1993 | Peake, III et al. | 66/194 |
| 5,304,162 | A | 4/1994 | Kuen | 604/391 |
| 5,326,612 | A | 7/1994 | Goulait | |
| 5,380,313 | A | 1/1995 | Goulait et al. | 604/391 |
| 5,382,461 | A | 1/1995 | Wu | 539/86 |
| 5,383,872 | A | 1/1995 | Roessler et al. | 604/391 |
| 5,386,595 | A | 2/1995 | Kuen et al. | 2/400 |
| 5,391,424 | A | 2/1995 | Kolzer | |
| 5,403,302 | A | 4/1995 | Roessler et al. | |
| 5,407,439 | A | 4/1995 | Goulait | 604/391 |
| 5,407,722 | A | 4/1995 | Peake, III et al. | 428/88 |
| 5,423,789 | A | 6/1995 | Kuen | |
| 5,447,590 | A | 9/1995 | Gilpatrick | 156/178 |
| 5,449,530 | A | 9/1995 | Peake, III et al. | 427/244 |
| 5,470,417 | A | 11/1995 | Goulait | 156/201 |
| 5,476,702 | A | 12/1995 | Datta et al. | 428/99 |
| 5,500,268 | A | 3/1996 | Billarant | 428/100 |
| 5,518,795 | A | 5/1996 | Kennedy et al. | 428/100 |
| 5,531,732 | A | 7/1996 | Wood | |
| 5,542,942 | A | 8/1996 | Kline et al. | |
| 5,547,531 | A | 8/1996 | Allen et al. | |
| 5,554,239 | A | 9/1996 | Datta et al. | |
| 5,565,255 | A | 10/1996 | Young et al. | 428/92 |
| 5,586,371 | A | 12/1996 | Thomas | 24/452 |
| 5,595,567 | A | 1/1997 | King et al. | |
| 5,605,729 | A | 2/1997 | Mody et al. | 428/37 |
| 5,611,791 | A | 3/1997 | Gorman et al. | |
| 5,614,232 | A | 3/1997 | Torigoe et al. | |
| 5,614,281 | A | 3/1997 | Jackson et al. | |
| 5,615,460 | A | 4/1997 | Weirich et al. | |
| 5,616,155 | A | 4/1997 | Kronzer | 51/295 |
| 5,616,394 | A | 4/1997 | Gorman et al. | |
| 5,618,583 | A | 4/1997 | Young et al. | 427/277 |
| 5,620,779 | A | 4/1997 | Levy et al. | |
| 5,622,578 | A | 4/1997 | Thomas | |
| 5,624,427 | A | 4/1997 | Bergman et al. | |
| 5,647,864 | A | 7/1997 | Allen et al. | |
| 5,654,070 | A | 8/1997 | Billarant | 428/400 |
| 5,664,302 | A | 9/1997 | Thomas | 24/452 |
| 5,669,900 | A | 9/1997 | Bullwinkel et al. | 604/391 |
| 5,669,901 | A | 9/1997 | LaFortune et al. | 604/391 |
| 5,685,756 | A | 11/1997 | Noda | 442/327 |
| 5,695,377 | A | 12/1997 | Triebes et al. | 442/359 |
| 5,699,593 | A | 12/1997 | Jackson | 24/445 |
| 5,707,707 | A | 1/1998 | Burnes et al. | 428/95 |
| 5,722,968 | A | 3/1998 | Datta et al. | 604/391 |
| 5,736,214 | A | 4/1998 | Billarant | 428/92 |
| 5,747,584 | A | 5/1998 | Noda | 524/801 |
| 5,773,120 | A | 6/1998 | Deka et al. | 428/99 |
| 5,843,057 | A | 12/1998 | McCormack | 604/367 |
| 5,858,515 | A | 1/1999 | Stokes et al. | 428/195 |
| 5,888,607 | A * | 3/1999 | Seth et al. | 428/92 |
| 5,891,547 | A * | 4/1999 | Lawless | 428/92 |
| 6,329,016 | B1 | 12/2001 | Shepard et al. | |
| 6,342,285 | B1 | 1/2002 | Shepard et al. | |

FOREIGN PATENT DOCUMENTS

| | | |
|---|---|---|
| EP | 0 780 505 A2 | 6/1997 |
| EP | 0 937 420 A2 | 8/1999 |
| GB | 2285 093 A | 6/1995 |
| GB | 2 290 052 | 12/1995 |
| JP | 2-41156 | 2/1990 |
| JP | 2-191735 | 7/1990 |
| JP | 4-56008 | 5/1992 |
| JP | 6-33359 | 2/1994 |
| JP | 6-123061 | 5/1994 |
| JP | 6-141913 | 5/1994 |
| JP | 07300752 A | 11/1994 |
| JP | 7-231842 | 9/1995 |
| JP | 71-71011 | 11/1995 |
| JP | 8-27657 | 1/1996 |
| JP | 9-195153 | 7/1997 |
| JP | 9-195154 | 7/1997 |
| JP | 09-195155 | 7/1997 |
| JP | 9-309168 | 12/1997 |
| JP | 10-146207 | 6/1998 |
| JP | 10-151005 | 6/1998 |
| JP | 10-165207 | 6/1998 |
| JP | 10-259560 | 9/1998 |
| WO | WO 92/01401 | 2/1992 |
| WO | WO95/17111 | 6/1995 |
| WO | WO 96/03101 | 2/1996 |
| WO | WO 96/14459 | 5/1996 |
| WO | WO 98/33410 | 8/1998 |

* cited by examiner

FASTENER LOOP MATERIAL, ITS MANUFACTURE, AND PRODUCTS INCORPORATING THE MATERIAL

CROSS-REFERENCE TO RELATED APPLICATIONS

This application is a continuation-in-part of U.S. patent application Ser. No. 09/996,618, filed Nov. 27, 2001, now U.S. Pat No. 6,783,834 which is a continuation of U.S. patent application Ser. No. 09/262,159, filed Mar. 3, 1999, now U.S. Pat. No. 6,329,016, which is a continuation-in-part of U.S. patent application Ser. No. 08/922,292, filed Sep. 3, 1997, now U.S. Pat. No. 6,342,285, and which also claims the benefit of PCT Patent Application US98/18401, filed Sep. 3, 1998 and designating the United States.

TECHNICAL FIELD

This invention relates to loop material, particularly to material to be engaged with hooking members to form a fastening, to its manufacture and use, and to fasteners comprising such loop material.

BACKGROUND

In the production of woven and non-woven materials, it is common to form the material as a continuous web that is subsequently spooled. In woven and knit loop materials, loop-forming filaments or yarns are included in the structure of a fabric to form upstanding loops for engaging hooks. As hook-and-loop fasteners find broader ranges of application, especially in inexpensive, disposable products, some forms of non-woven materials have been suggested to serve as a loop material to reduce the cost and weight of the loop product while providing adequate closure performance in terms of peel and shear strength. Nevertheless, cost of the loop component has remained a major factor limiting the extent of use of hook and loop fasteners.

To adequately perform as a loop component for touch fastening, the loops of the material must be exposed for engagement with mating hooks. Unfortunately, compression of loop material during packaging and spooling tends to flatten standing loops. In the case of diapers, for instance, it is desirable that the loops of the loop material provided for diaper closure not remain flattened after the diaper is unfolded and ready for use.

SUMMARY

We have realized that non-woven fabrics constructed with certain structural features are capable of functioning well for their intended purpose as hook-engageable loop fabrics, while providing particular advantage in regard to expense of manufacture and other properties.

In general, the invention features loop products for hook and loop fasteners, and method of making such loop products.

In one aspect, the invention features a loop product for hook-and-loop fastening, the loop product comprising a non-woven web of entangled fibers, the fibers forming a sheet-form web body stabilized in a condition of at least about 20 percent areal stretch, in which hook-engageable loops extend in clusters from tightened entanglements within the web body, the entanglements being joined together by straightened fibers, the product having a basis weight of less than about 4 ounces per square yard wherein the fibers comprise a blend of relatively higher denier fibers and relatively lower denier fibers.

In another aspect, the invention features a loop product for hook-and-loop fastening, the loop product comprising a non-woven web of entangled fibers, the fibers forming a sheet-form web body stabilized in a condition of at least about 20 percent areal stretch, in which hook-engageable loops extend in clusters from tightened entanglements within the web body, the entanglements being joined together by straightened fibers, the product having a basis weight of less than about 4 ounces per square yard and at least some of the fibers having a fiber denier of less than 3.

Some implementations of these aspects of the invention include one or more of the following features. The majority of the fibers have a fiber denier of 3 or less. At least some of the fibers have a fiber denier of 1.5 or less. The relatively higher denier fibers have a fiber denier of 6 or greater and the relatively lower denier fibers have a fiber denier of less than 6. The relatively lower denier fibers have a fiber denier of 3 or less, e.g., 1.5 or less. The relatively higher denier fibers have a denier of from 2.5 to 3.5 and the relatively lower denier fibers have a denier of from about 1.0 to 2.0.

The web body is stabilized in a condition of at least 10 percent stretch in each of two perpendicular directions. The web body is stabilized in a condition of at least 25 percent stretch in each of two perpendicular directions. The tightened entanglements are present in a density of between about 50 and 1000 entanglements per square inch of web body. The fibers have a tenacity of at least 2.8 grams per denier, e.g., at least 5 grams per denier, more preferably at least 8 grams per denier. The fibers are of a material selected from the group consisting of polyester, polyurethane, polypropylene polyethylene, nylon, homopolymers, mixtures, copolymers, alloys, or coextrusions thereof, natural fibers, and blends thereof. The fibers are a blend of polyester and polypropylene. The loop product has a Gurley stiffness of less than about 300 milligrams. The loop product has a basis weight of less than about 2 ounces per square yard.

The loop product includes polymer filaments entangled among the fibers, the filaments being at least partially melted to bond the web body. The fibers include bicomponent fibers prior to stabilization of the web, the bicomponent fibers including a first polymer that melts during stabilization to provide a stabilizing binder, and a second polymer that does not melt during stabilization. The nonwoven web is stabilized in its stretched state by material adhered to a back surface of the web, e.g., a solidified binder material. The nonwoven web is stabilized in its the stretched state by solidified fibers of low melt polymer. The binder material includes a backing. The binder material includes an impermeable barrier. The binder includes a fire-retardant material.

The loop product further includes a layer adhered to a surface of the nonwoven web opposite the surface from which the loops extend. The layer includes a supporting fabric. The loop product includes a carrier layer laminated to a surface of the nonwoven web opposite the surface from which the loops extend. The carrier layer includes a film. The nonwoven web is laminated to one side of the carrier layer, and the opposite side of the carrier layer is provided with a layer of pressure-sensitive adhesive for application to a surface. The binder forms a backing that is adapted to be welded to a substrate. The binder forms a water-resistant layer. The loop product further includes a resilient layer of foam disposed on a surface of the non-woven web opposite the surface from which the loops extend. The loop product further includes an optically scannable image printed on the loop-carrying surface of the non-woven web. The loop product further includes a layer of resin disposed on a surface of the non-woven web opposite the surface from which the loops extend. The resin layer includes hook projections shaped to engage the hook-engageable loops.

In various aspects, the invention features a loop product including a non-woven web of entangled fibers, the fibers forming a sheet-form web body stabilized with binder in a condition of at least about 20 percent areal stretch, in which hook-engageable loops extend in clusters from tightened entanglements within the web body, the entanglements being joined together by straightened fibers, the product having a basis weight of less than about 4 ounces per square yard.

In one such aspect, the fibers include bicomponent fibers prior to stabilization of the web, the bicomponent fibers including a first polymer that melts during stabilization to provide the binder, and a second polymer that does not melt during stabilization.

In another such aspect, the binder includes a stable foam coating.

In a further aspect, the binder includes a polymer film.

In another aspect, the invention features a loop product including a non-woven web of entangled fibers, the fibers forming a sheet-form web body stabilized with binder in a condition of areal stretch, in which hook-engageable loops extend in clusters from tightened entanglements within the web body, the entanglements being joined together by straightened fibers, the product having a basis weight of less than about 4 ounces per square yard, wherein the fibers include a blend of relatively higher denier fibers and relatively lower denier fibers.

The invention also features methods of making loop products.

In one aspect, the invention features a method of forming a loop product from a generally planar non-woven batt of entangled fibers, the fibers including bicomponent fibers that include a first polymer having a first melting temperature and a second polymer having a second melting temperature that is relatively higher than the first melting temperature. The method includes (a) stretching the batt by at least 20 percent in at least one direction in its plane, thereby producing a stretched web of weight less than about 4 ounces per square yard and having a generally planar web body with hook-engageable loops extending therefrom, a substantial number of fibers of the body being regionally taut in the plane of the web body, and extending in different directions radiating from bases of the loops; and (b) stabilizing the web in its stretched condition by heating the web to a temperature that is between the first and second melting temperatures, causing the first polymer to melt and act as a binder.

In another aspect, the invention features a method of forming a loop product from a generally planar non-woven batt of entangled fibers, including (a) stretching the batt by at least 20 percent in at least one direction in its plane, thereby producing a stretched web of weight less than about 4 ounces per square yard and having a generally planar web body with hook-engageable loops extending therefrom, a substantial number of fibers of the body being regionally taut in the plane of the web body, and extending in different directions radiating from bases of the loops; and (b) stabilizing the web in its stretched condition by applying a stable foam to a surface of the web opposite the surface from which the hook-engageable loops extend.

In a further aspect, the invention features a method of forming a loop product from a generally planar non-woven batt of entangled fibers, including (a) stretching the batt by at least 20 percent in at least one direction in its plane, thereby producing a stretched web of weight less than about 4 ounces per square yard and having a generally planar web body with hook-engageable loops extending therefrom, a substantial number of fibers of the body being regionally taut in the plane of the web body, and extending in different directions radiating from bases of the loops; and (b) stabilizing the web in its stretched condition by extruding a polymer film onto a surface of the web opposite the surface from which the hook-engageable loops extend.

Some implementations of these methods may include one or more of the following features. The batt is retained against shrinking in a perpendicular direction within its plane during stretching. The method further includes, after stretching the batt in the one direction, stretching the batt by at least 20% in the perpendicular direction. Stretching increases the area of the batt by at least 50%.

In yet another aspect, the invention features a method of forming a loop product including (a) forming a nonwoven web having hook-engageable loops extending from a first surface; and (b) extruding a polymeric film onto a second surface of the nonwoven web, opposite the first surface.

The invention also features a method of forming a loop fastener product, including (a) forming a nonwoven web having hook-engageable loops extending from a first surface; and (b) applying a layer of a stable foam onto a second surface of the nonwoven web, opposite the first surface.

If desired, an optically scannable image may be printed on the surface of the web from which the loops extend, and/or an adhesive may be applied to the exposed surface of the stable foam.

The invention also features a loop product including (a) a non-woven web of entangled fibers, the fibers forming a sheet-form web body stabilized with binder in a condition of at least about 20 percent areal stretch, in which hook-engageable loops extend in clusters from tightened entanglements within the web body, the entanglements being joined together by straightened fibers, and (b) a foam layer disposed on a surface of the non-woven web opposite the surface from which the hook-engageable loops extend.

Some implementations may include one or more of the following features. The product further includes an optically scannable image printed on the surface from which the hook-engageable loops extend. The stable foam is water resistant. The product further includes a layer of adhesive disposed on an exposed surface of the layer of stable foam.

In a further aspect, the invention features a loop product including (a) a non-woven web of entangled fibers, the fibers forming a sheet-form web body stabilized with binder in a condition of at least about 20 percent areal stretch, in which hook-engageable loops extend in clusters from tightened entanglements within the web body, the entanglements being joined together by straightened fibers, and (b) an optically scannable image printed on a surface of the non-woven web from which the hook-engageable loops extend.

By "hook-engageable" and similar terms used above and throughout this specification, we mean that the loop material defines openings of size adequate to receive the tip or head portion of a male fastener element (such as a hook-shape or mushroom-shape element, for instance) for forming a fastening, and that the openings are exposed and extended for engagement.

By the word "entanglements" we mean that the nodes at which a multiplicity of fibers are intertwined in the non-woven web. These entanglements may be relatively loose, as formed directly by a needling process, for instance, or tightened after formation of the entanglements. By the word "knots" we mean entanglements that have been tightened by applying tension to their intertwined fibers in at least one direction in the plane of the web, and remain in an at least partially tightened state.

By "stabilized", we mean that the web is processed to generally maintain its planar dimensions. In other words, a web "stabilized" in a stretched condition will generally maintain its stretched dimensions and not significantly relax or stretch further under conditions of normal use. One way of "stabilizing" the web, for instance, is by solidifying binder at a significant proportion of its entanglements.

Other features and advantages of the invention will be apparent from the description and drawings, and from the claims.

DETAILED DESCRIPTION

Figure 1:
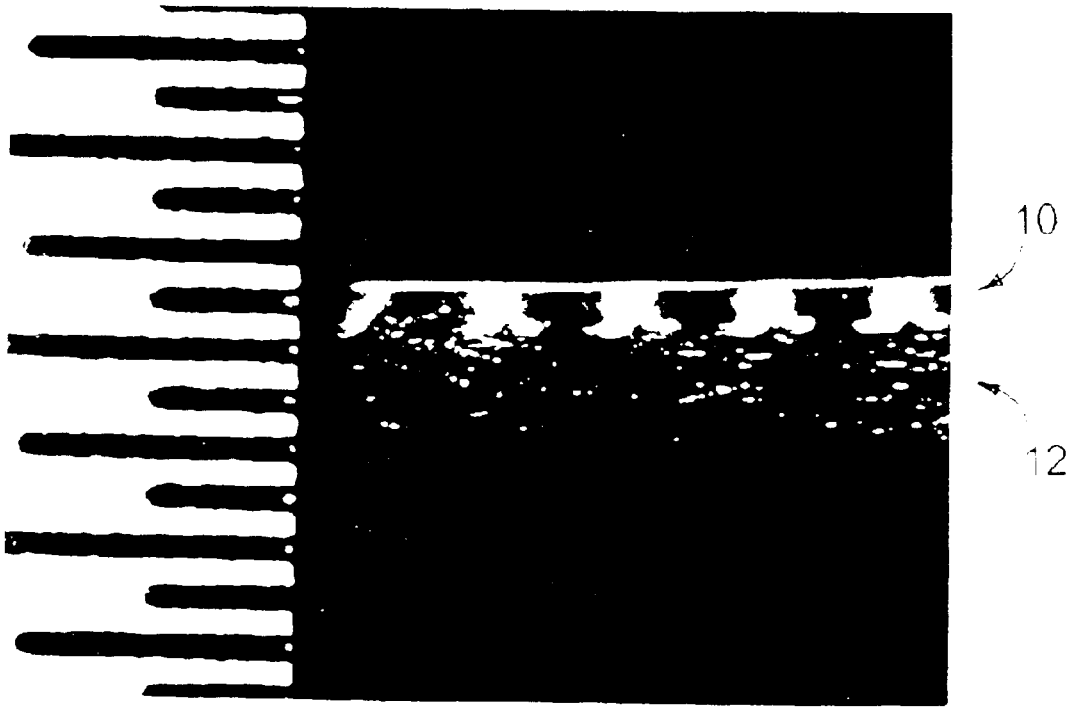
FIG. 1 is an enlarged side view of a hook-and-loop fastener.
Figure 2:
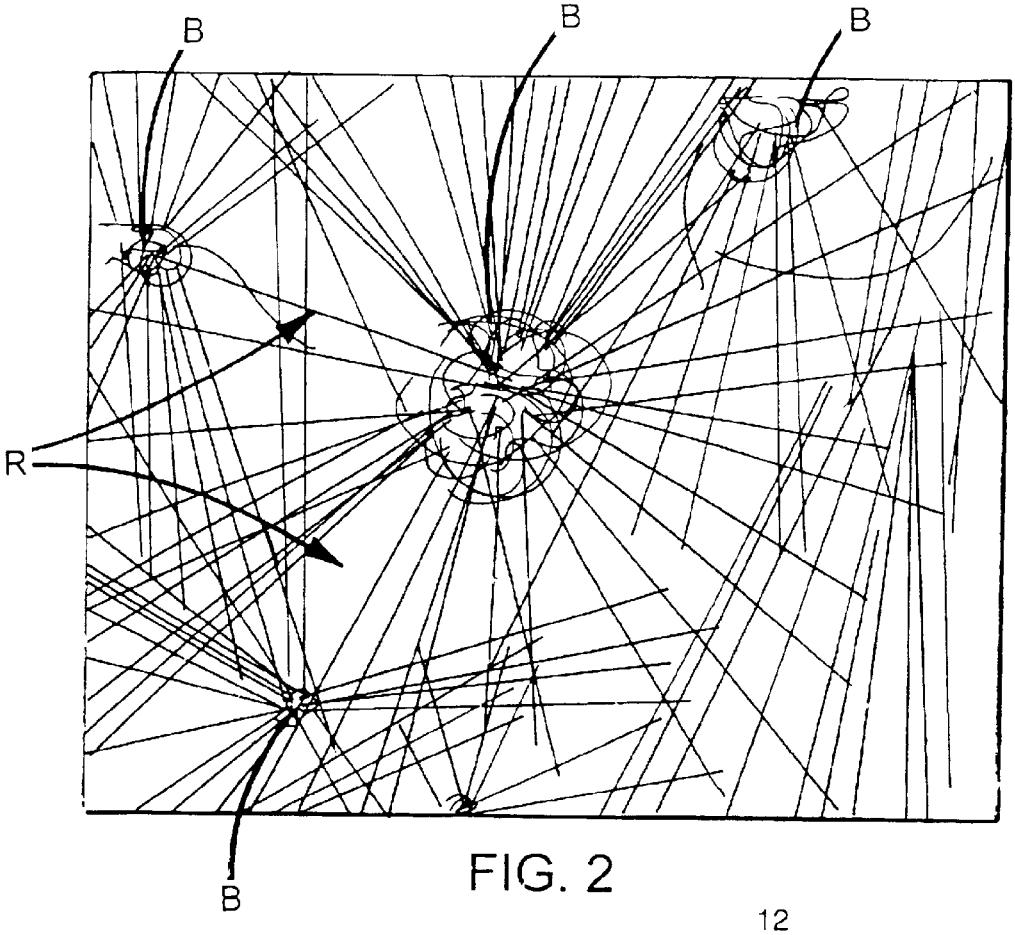
FIG. 2 is a schematic view of a loop fastener product.

Referring first to FIG. 1, a molded hook fastener product 10 is shown engaging the loops of a very thin loop product 12. The photograph is quite enlarged, as shown by the scale on the left side of the photograph. The minor divisions of the scale each represent a length of 1/64th (0.0156) inch (0.40 mm). Hook product 10 is of the CFM-29 designation, available from Velcro U.S.A Inc. of Manchester, N.H., U.S.A., and has hooks of only 0.015 inch (0.38 mm) height. Referring also to FIG. 2, loop product 12 is very thin and has relatively free fibers forming loops extending from one side of a continuous, tangled mat of fibers.

As shown in FIG. 2, a substantial number of the fibers of the mat of loop product 12 are taut (i.e., not slack, regionally straight), extending between knots 18 of the loop product fabric. The taut fibers have been pulled taught by stretching the mat of tangled fibers in at least one direction in the plane of the fabric mat. Preferably, the mat is held against shrinking in one direction as it is stretched in a second, perpendicular direction. More preferably, the mat is simultaneously stretched in two perpendicular directions. The individual fibers of the mat follow no definite pattern as in a woven product, but extend in various directions within the plane of the fabric mat. The loops that extend from the loop product are of the same fibers that comprise the mat but extend beyond the general mass of the mat, out of the plane of the mat, generally from associated knots 18. The knot density of the sample shown in FIG. 1 was determined to be approximately 180 knots per square inch by counting the number of visible knots within a given square area.

The knots themselves are fairly tight, made up of several monofilament fibers, and are interconnected by the taut fibers seen running between them. In between knots, in this embodiment the thin fiber mat is not very dense and is sheer enough to permit images to be readily seen through it. In other embodiments, as will be discussed below, the fiber mat may be relatively dense and opaque. For low cost applications, the fabric preferably weighs less than about 2 ounces per square yard (68 grams per square meter).

In this particular embodiment, the fibers of the mat are held in their taut, straightened condition by a water-based, acrylic binder applied to the side of the mat opposite the loops to bind the mat fibers in their taut condition to stabilize the areal dimensions of the fabric, and to secure the loops at their associated knots. The binder generally ranges between 20 and 40% of the total weight of the fabric and in the presently preferred embodiments accounts for about one third of the total product weight. The resulting fabric is dimensionally stable and strong enough to be suitable for further processing by standard fabric-handling techniques. The fabric also has a slight stiffness, like a starched felt, which can be mitigated by softeners or mechanical working if desired.

The schematic view of FIG. 2 illustrates the structure of planar web 12, as viewed from one face of the web. In this view, the loop-engageable loops extend out of the plane of the web, from one side. Web 12 is composed of a non-uniform distribution of entangled fibers, with relatively high concentrations of the fibers at the bases, B, of corresponding loop structures, and relatively lower concentrations of the fibers in regions, R, lying between loop bases, B. The relatively high concentrations of fibers at bases B correspond to tightened fiber entanglements. As illustrated in FIG. 2, a substantial number of the fibers in the regions, R, between loop bases are taut in the plane of the web, extending in different directions radiating from loop bases, B. By "taut", we mean that a large percentage of these inter-base fibers have no give or slack, such that they may transmit an applied tensile force with little or no displacement. We believe that the taut fiber portions extending across the sparse regions between loop bases account for some of the beneficial properties of the loop product, giving it a perceptibly high strength-to-weight ratio as a fastener component.

Near the center of FIG. 2 is a particularly visible loop base B, from which taut fibers can be seen emanating in a radial pattern. Also note that there are some fibers that are wrapped at least partially about other fibers of the loop base. These wrapping fibers are so wrapped as the result of stretching, during which straightening fibers encounter loop fibers extending through the planar web. As the web is further stretched, the loop fibers provide obstructions about which the straightening web base fibers are trained as they are displaced within the web plane. Thus the bases, B, of the loop structures contain both portions of the loop-forming fibers extending both in and out of the plane of the web, and trained portions of taut fibers lying generally only in the plane of the web. The trained portions of the taut fibers within the loop bases therefore contribute, as the web is stretched, to the definition of the free-standing loop formations. When the web is stabilized by binder, for instance, these bases B become relatively rigid nodes and, importantly, provide anchoring for their associated loop structures. Thus the stretched and stabilized web, in some respects, resembles a planar truss, with its taut radiating fibers forming tensile members between base nodes. As the taut fibers may be readily "bent" out of their plane as the web flexes, the structure retains an advantageously high flexibility while resisting elongation and shrinkage within its original plane.

The individual fibers of loop fabric 12 have low denier and substantial tenacity (i.e., tensile strength per unit diameter) to work with very small hooks such as those illustrated in FIG. 1. Fibers with tenacity values of at least 2.8 grams per denier have been found to provide good closure performance, and fibers with a tenacity of at least 5 or more grams per denier (preferably even 8 or more grams per denier) are even more preferred in many instances. In general terms for a loop-limited closure, the higher the loop tenacity, the stronger the closure. The fibers of fabric 12 of FIG. 1 are 6 denier staple polyester fibers (cut to four inch lengths) and as a result of the method of the manufacture, are in a drawn, molecular oriented state, having been drawn with a draw ratio of at least 2:1 (i.e., to at least twice their original length) under cooling conditions that enable molecular orientation to occur, to provide a fiber tenacity of about 3.6 grams per denier. The fibers in this example are of round cross-section and are crimped at about 7.5 crimps per inch (3 crimps per cm). Such fibers are available from E. I. Du Pont de Nemours & Co., Inc., in Wilmington, Del. under the designation T-3367 PE T-794W 6×4. For low-cycle applications for use with larger hooks (and therefore preferably larger diameter loop fibers), fibers of lower tenacity may be employed.

The loop fiber denier may be chosen with the hook size in mind, with lower denier fibers typically selected for use with smaller hooks. However, other performance and aesthetic criteria may also influence the selection of loop fiber denier, as will be discussed below.

As an alternative to round cross-section fibers, fibers of other cross-sections having angular surface aspects, e.g. fibers of pentagon or pentalobal cross-section, can enhance knot tightening for certain applications. Regardless of the particular construction of the individual fibers, they are selected to have a surface character that permits slippage within the knot-forming entanglements during tightening so as to enable stretching the batt without undue fiber breakage.

Figure 3:
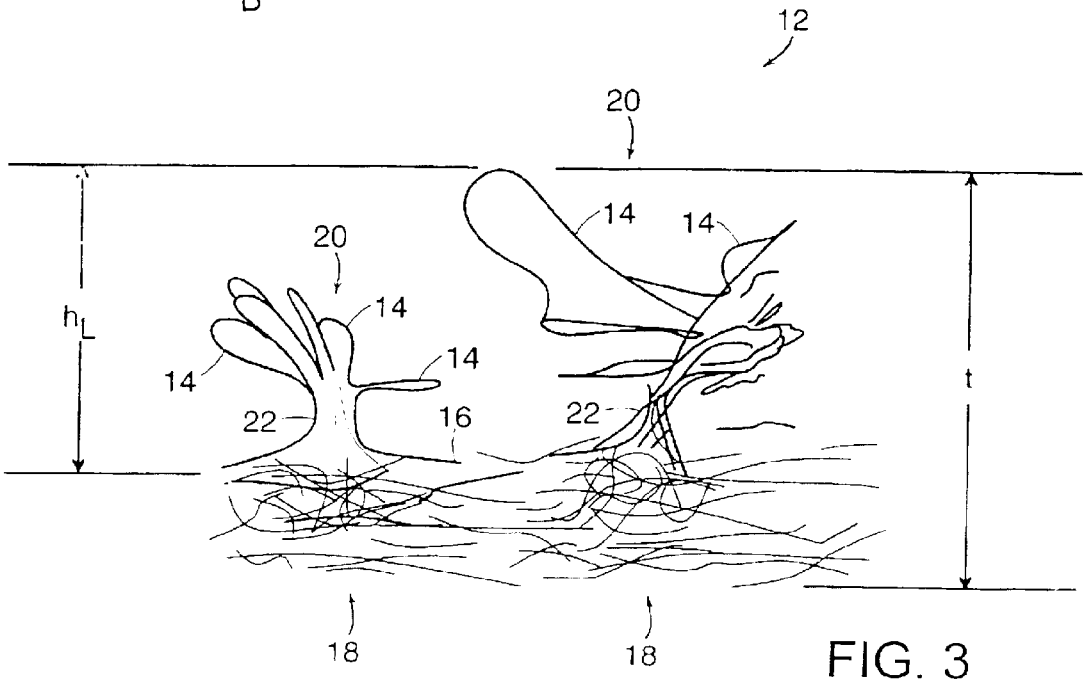
FIG. 3 is a diagrammatic highly enlarged side view of the loop fastener product of FIG. 2.
Figure 3A:
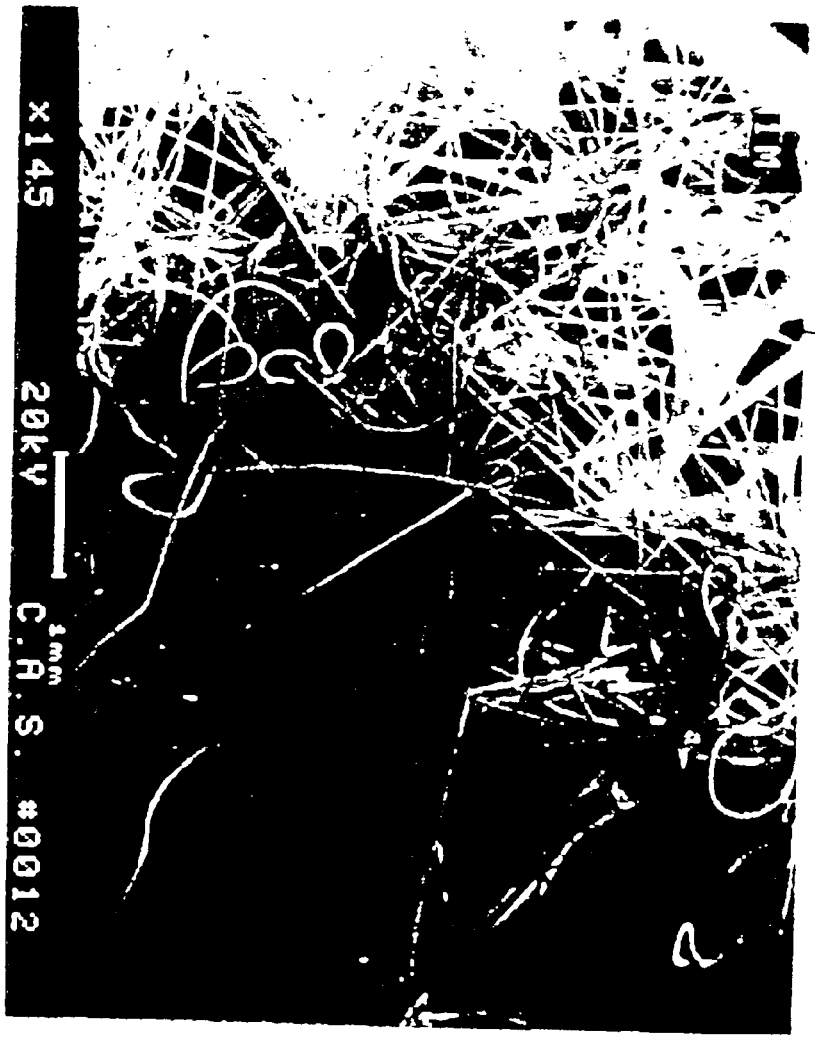
FIG. 3A is a highly enlarged plan view of a portion of the loop fastener product of FIG. 2.

Referring to FIGS. 3 and 3A, the loops 14 of loop fabric 12 project primarily from one side of the fabric. The stabilizing binder, in this case, is applied to the other side. The loop product is extremely thin for use with very small hooks. The product shown, for instance, works well with hooks of about 0.015 inch (0.4 mm) height and has a loop height $h_L$ (i.e., the height of loops 14 from the near general surface of fiber mat 16) of about 0.055 inch (1.40 mm). The loop product has an overall thickness, t, including a majority of the loops, of only about 0.090 inch (2.3 mm). When measuring loop height in products without a visibly distinguishable upper mat surface, we define the near surface of the mat to be the lowest planar surface above about 80 percent of the total mass of fibers. The loops of the loop structures preferably vary in height for good engagement, and the average loop height (i.e., the distance from the top of the loop to the near surface of the mat) should generally be at least about the height of the hooks with which the loop product is to be used, and preferably between 2 and 10 times the head height of the hooks used for applications requiring good shear strength. Importantly, individual loops of the loop structures should be large enough to accept the head of an individual hook. For fasteners which are primarily loaded in peel, or by loads perpendicular to the plane of the base, the loops may be up to 15 times the head height of the hooks. For example, for use with 0.015 inch (0.4 mm) CFM-29 hooks (which have a head height of 0.006 inch or 0.15 mm), the average height $h_L$ of the loops should be between about 0.012 and 0.060 inch (0.3 and 1.5 mm) for good shear performance. For use with 0.097 inch (2.5 mm) CFM-24 hooks (which have a head height of 0.017 inch or 0.43 mm and are also available from Velcro U.S.A. Inc.), the average height of the loops should be at least 0.035 inch (0.89 mm) and may be as high as 0.250 inch (6.4 mm) for applications focusing on peel loading. For low cost, flexible loop fabrics, the average loop height should generally be between about 0.020 and 0.060 inch (0.5 and 1.5 mm), and should be between about 0.5 and 0.8 times the overall thickness, t, of the loop product.

As seen in FIGS. 3 and 3A, loops 14 extend from free-standing clusters of loop fibers extending from the fibrous mat 16. The clusters 20 which have several monofilament loops 14 extending from a common elongated, substantially vertical trunk 22 we call "loop trees". Another example of a "loop tree" is seen in FIG. 3A. Each loop tree 20 extends from a corresponding knot 18 in which the loops of the cluster are anchored. Interstices between individual filaments in the trunk portion 22 and base of each tree, and in each knot 18, provide paths for the wicking of liquid binder, under the influence of surface tension of the liquid binder, to provide additional localized stiffness and strength. The vertical stiffness of the trunk portion 22 of each tree, provided both by the bundling of multiple trunk fibers by circumscribing fibers of the base and by the cured binder, helps the trees to "stand proud", or erect, to present their associated loops for engagement. This vertical stiffness acts to resist permanent crushing or flattening of the loop structures, which can occur when the loop material is spooled or when the finished product to which the loop material is later joined is compressed to be fit into packaging. Resiliency of the trunk portion 22, especially at its juncture with the base, enables trees that have been "toppled" by heavy crush loads to right themselves when the load is removed. The trunk portions 22 should not be too stiff at their interface with the base of the loop material, otherwise the material would lose its soft hand and be less useful for garment applications.

Importantly, the density of clusters in the plan view is very low (FIG. 2), leaving sufficient room between the "branches" of neighboring trees to accommodate hooks and deflected loop material during engagement. By leaving adequate room between neighboring loop trees, the heads of many of the hooks of a mating material extend down to the base of the loop material during engagement, without flattening the loop structures. This high penetration rate helps to provide a high engagement rate as the penetrating hooks grab loops as a result of very small relative shear motion between the hooks and the loops while the loop forest is thus penetrated.

Accumulations of solidified binder 21 can be seen in the knots in the highly magnified plan view of FIG. 3A. Applied in liquid form in this example, preferably before the knots are tightened, the binder contributes to securing the loops against being pulled out of the web.

Referring back to FIG. 1, with proper clearance between loops for the accommodation of hooks, the fully engaged fastener (i.e., the loop product and mating hook product together) has an overall thickness of only the sum of the thickness of the hook product (including hooks) and the "ground" portion of the loop product (i.e., the thickness of the mat 16 between loop clusters, FIG. 3). In other words, the free standing loops of the loop product do not add to the thickness of the completed fastener. Because of the ultra-thin ground portion 16 of the loop product disclosed herein (see FIG. 3), the combination of loop product 12 with mating hook product 10 provides a fastening of very small thickness. For example, the engaged fastener of FIG. 1 has an overall thickness of only about 0.050 inch (1.3 mm; thinner, in this case, than the overall thickness of the unengaged loop product, as the taller loop clusters are somewhat compressed by the hook product engaged with shorter loop clusters).

In addition to being advantageously thin, loop fabric formed according to the new principles is particularly flexible. Flexibility can be very important in some fastener applications, especially when the fastener must flex during use, as when used on an article of apparel. In such instances, the loop product of the invention should have a bending stiffness of less than about 300 milligrams, preferably less than about 100 milligrams, as measured with a Gurley stiffness tester. More details on the use of Gurley stiffness testers can be found in Method T 543 OM-94, published in 1984 by the Technical Association of Pulp and Paper (TAPPI).

Various synthetic or natural fibers may be employed in the invention. In some applications, wool and cotton may provide sufficient fiber strength. Presently, thermoplastic staple fibers which have substantial tenacity are preferred for making thin, low-cost loop product that has good closure performance when paired with very small molded hooks. For example, polyolefins (e.g., polypropylene or polyethylene), polyesters (e.g., polyethylene terephthalate), polyamides (e.g., nylon), acrylics and mixtures, alloys, copolymers and coextrusions thereof are suitable. Polyester is presently preferred. Polypropylene is desirable due to its relatively low density, allowing a greater amount of fiber per unit weight, its flexibility, and its weldability to polypropylene products such as the outer covering of diapers. However, polypropylene is incompatible with many binders, so in some cases blends of polypropylene and polyester may be preferable to polypropylene alone.

Relatively low denier fibers, e.g., 3 denier or less, and blends of different denier fibers, may provide advantageous aesthetic and performance properties.

Figure 8:
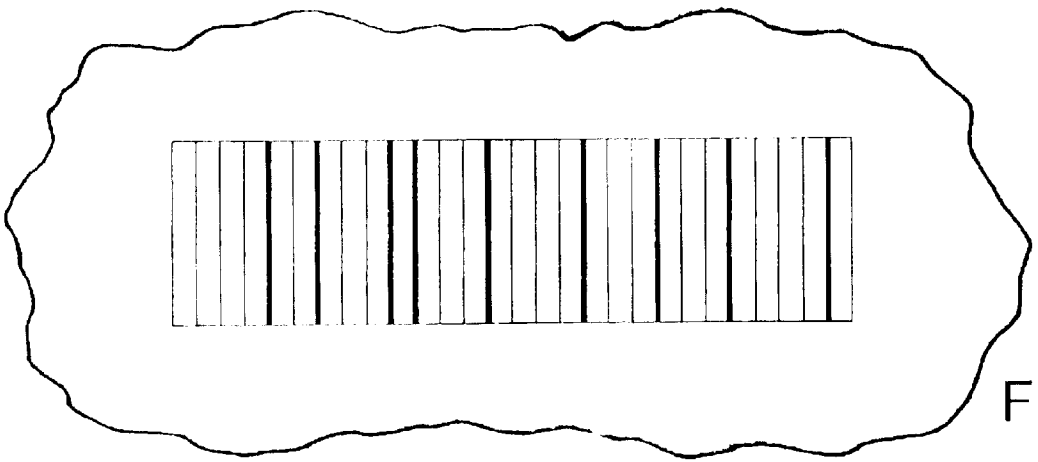
FIG. 8 is a diagrammatic view of an optically scannable image printed on a loop fastener product.

Generally, smaller fiber deniers increase the fiber density per unit weight of the fabric, resulting in greater softness and opacity. Greater opacity improves the aesthetics of the fabric and facilitates printing on the fabric, particularly of detailed information such as optically scannable images, e.g., bar codes (see, e.g., FIG. 8). The reduced porosity of the fabric may also allow the fabric to be moved by vacuum transfer, a technique that is often used in labeling equipment. The higher fiber density also generally results in a more uniform web of fabric, reducing product inconsistency.

More fiber per unit weight also generally translates to more loops available for engagement with hooks, which tends to improve the performance of the product, allowing more closure cycles to be obtained without excessive damage to the fabric, and providing better peel strength. Fiber deniers of from 1 to 3 will generally provide these benefits.

Smaller fiber deniers may also result in a higher knot density, providing stronger anchoring of the loops. Moreover, at smaller fiber deniers the loop trees will tend to contain more fibers per tree, resulting in bushier trees and better surface coverage with hook engageable loops.

Blends of fibers of different deniers also provide improved properties. Fabrics containing blends of 3 denier and 1.5 denier fibers, for example, have been found to provide significantly better peel strength, shear strength and opacity than fabrics containing all 6 denier fiber or all 3 denier fiber. Fabrics made with these blends also have a "plushier", softer feel. Many other different blends of fiber deniers may be used, including blends of relatively high (6 or greater) denier fibers with relatively low denier fibers. The preferred ratio of the different denier fibers can be determined empirically, depending on the properties that are required for a particular application. Ratios of 3 denier fibers to 1.5 denier fibers of from 1:3 to 3:1 have been found to provide good properties.

The fiber density generally is inversely proportional to the fiber denier, in a linear relationship. Thus, a loop product containing all 1.5 denier fibers would have about twice the fiber density of a loop product containing all 3 denier fibers, and about four times the fiber density of a loop product containing all 6 denier fibers. The approximate fiber density of blends of different denier fibers can be calculated based on this relationship.

For a product having some electrical conductivity, a small percentage of metal fibers may be added. For instance, loop products of up to about 5 to 10 percent fine metal fiber, for example, may be advantageously employed for grounding or other electrical applications.

Various binders may be employed to stabilize the fabric. By "binder" we mean a material within the mat (other than the fibers forming the main fastener loops) that secures the loop fibers at associated knots. In some applications, the binder is an adhesive.

In other applications, the binder is in the form of fibers of low-melt polymer dispersed throughout and entangled within the fabric. These low-melt fibers are melted to wet the knot-forming entanglements and then cooled and solidified to secure the loops and stabilize the fabric.

Similarly, the fibers used in the fabric may be bicomponent fibers, including both a high-melt and a low-melt polymer, the low-melt polymer being melted to secure the loops and stabilize the fabric. In this case, the low-melt polymer is generally provided as an outer sheath, surrounding a core of high-melt polymer that remains intact after the low-melt polymer has melted to act as a binder. Preferably the inner core makes up about 60 to 80% of the total volume of the bicomponent fiber. The low-melt and high-melt polymers may be different grades of the same polymer, or different types of polymers. Suitable bicomponent fibers are commercially available, for example from KoSa, Charlotte, N.C., under the tradename "CELBOND." It is generally preferred that the low-melt polymer have a melting temperature of less than 120° C., and that the high-melt polymer have a melting temperature of greater than 23° C., but these temperatures will vary depending on the processing temperatures used to stabilize the web.

In some embodiments, the binder may be a stable foam, as will be discussed below.

The binder preferably fully penetrates and permeates the interstices between individual fibers in the entanglements of the mat. When employing a liquid binder, the binder is preferably selected to have a sufficiently low viscosity and surface tension to enable it to flow into the untightened (or tightening) entanglements. In the embodiments in which the entanglements are subsequently tightened (such as the loop product shown in FIG. 2), this selected distribution of the fluid binder helps to secure the knots with minimal stiffening of the overall product and without requiring substantial amounts of binder.

In any event, the amount and penetration of the binder should be selected to avoid substantial interference with the desired hook-engaging function of the loops while adequately stabilizing the mat and securing the loops against being pulled from their associated entanglements. For use in applications in which the loop product may come in direct contact with sensitive skin, such as in diapers, the amount and type of binder should also be selected to be biocompatible to avoid skin irritation. Formaldehyde-free binders, for instance, are preferred. As irritation can be aggravated by stiffness, preferably only enough binder to perform the above functions is applied. In some applications, for instance those in which the loop product is directly adhered to a supporting fabric and which does not require substantial fastener strength, the loop product may be provided without a binder.

In important instances, the binder also includes an organic or inorganic fire-retardant, such as antimony oxide, zinc borate, aluminum trihydrate or decabromobiphenyl oxide.

The specific loop product 12 of FIG. 1 includes about one third by weight water-based acrylic binder produced by mixing 80 parts "NACRYLIC" X-4280, a self-reactive acrylic emulsion, with 20 parts "X-LINK" 2804, a self-crosslinking, polyvinyl acetate/acrylate emulsion, both available from National Starch and Resin Company in Bridgewater, N.J. As produced, loop product 12 substantially consists only of the drawn fibers of the thin mat, some of which extend out of the mat to form loops, and the binder. Without any additional backing or laminate, it is strong enough to be handled as a fabric material, and may be applied to surfaces as a closure member by sewing, ultrasonic welding, adhesive, radio frequency welding, or other known attachment means.

For instance, a hook-and-loop product may be formed by ultrasonically welding a piece of the loop material 12 of FIG. 2 to a piece of CFM-29 hook product. The resulting product can be formed into a closed band by engaging its loops with its hooks. At the interface between the hook product and the loop material, the plastic from the base of the hook product flows around and entraps some of the fibers of the base web of loop material 12, encapsulating one face of the web in thermoplastic material to form a permanent laminate of the two layers. Because of the extremely light nature of the non-woven material of the invention, care must be taken to only encapsulate the web and to leave the functional loops exposed for engagement with hooks. The properties of the non-woven material, the viscosity of the plastic and the pressure in the nip will determine the degree to which the plastic flows into the fibrous network, or put alternately, the degree to which the non-woven will imbed into the plastic. The resulting laminated product is particularly thin and flexible, due in part to the thinness of the loop material.

Suitable methods for forming such a laminated product are described, e.g., in WO 99/11452, published Mar. 11, 1999.

One of the underlying principles embodied in the formation of self-erecting loop trees is that pulling on a tangled bunch of fibers will form knots. This phenomenon is true with regard to continuous fibers (as any fisherman knows) as well as to bunches of short fibers tangled sufficiently to form a coherent mass. Simply stretching a tangled mass of fibers is insufficient to form an adequate number of erect loop trees, however. The formation of an erect structure of the proper height involves the tightening of adjacent fibers within the plane of the base of the mat about multiple tree-forming fibers at two spaced-apart points along each tree-forming fiber, which themselves remain untightened between such spaced-apart points.

Figure 4:
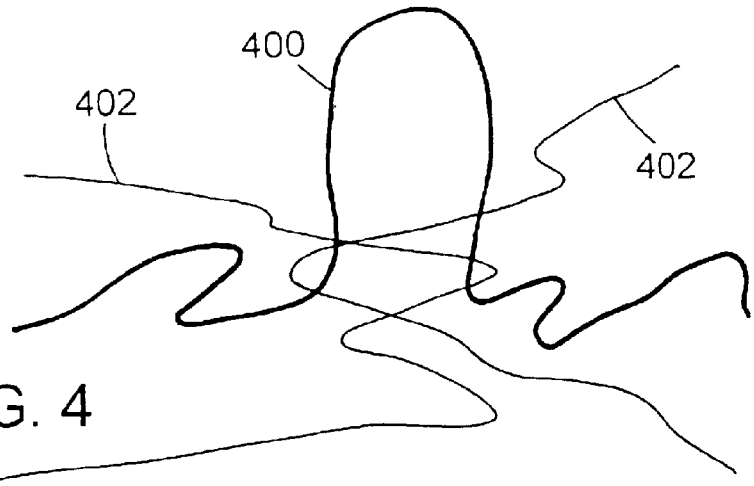
FIGS. 4–4B sequentially illustrate the formation of a loop tree.
Figure 4A:
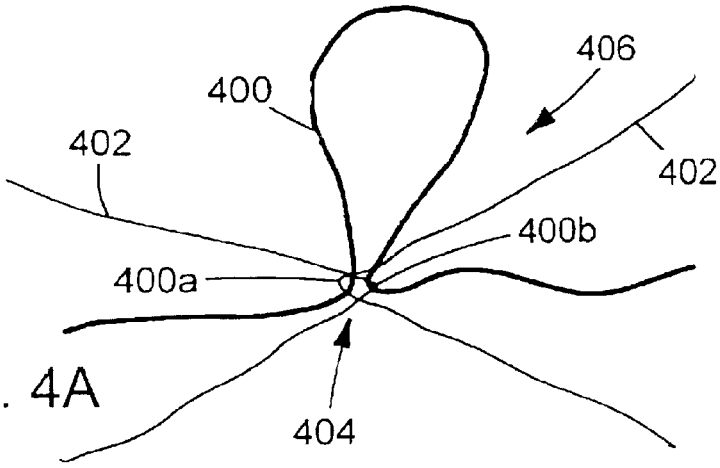
Figure 4B:
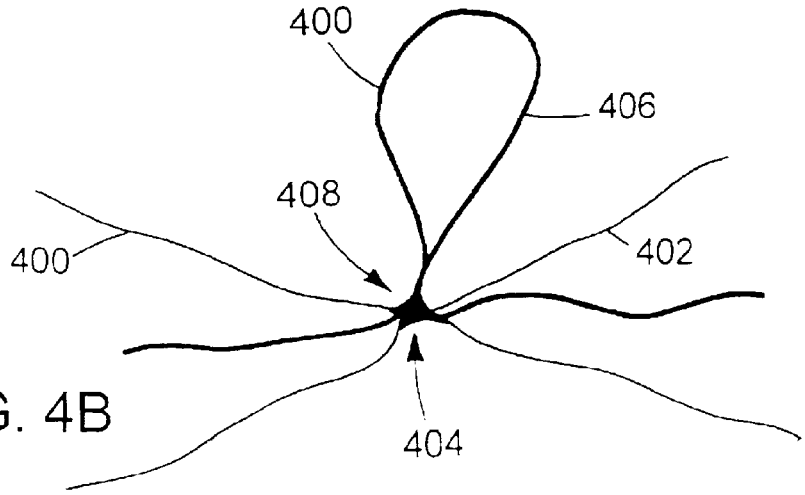

FIGS. 4–4B illustrate this tree-forming sequence. For clarity, only one tree-forming fiber 400 is shown (in bold for distinction), and only two tightening base fibers 402 are shown. Preferably, an average of at least three or four tree-forming fibers will be drawn together at any given knot to form a single trunk. Referring first to FIG. 4, all fibers are initially slack. As the fibers are pulled taut (FIG. 4A), fibers 402 tighten about fiber 400, drawing together spaced-apart points 400*a* and 400*b* into a tight entanglement 404 at the base of the loop structure 406 formed by the segment of fiber 400 between points 400*a* and 400*b*. The wicking of binder 408 into the interstices between fibers in knot 404 (FIG. 4B) adds rigidity to the trunk of the structure and its connection to the base. Again, with multiple tree-forming fibers 400 drawn together at a common entanglement 404, this process forms a standing loop tree with multiple extended loops.

Figure 5:
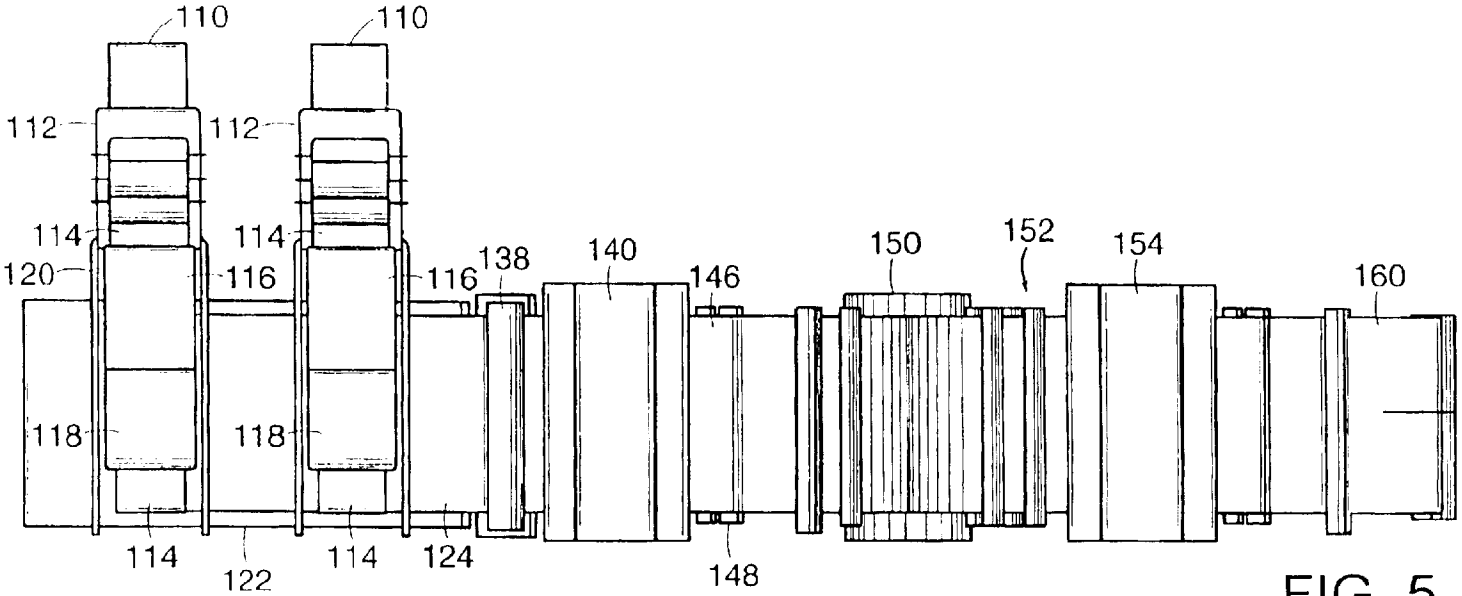
FIG. 5 is a top view of an apparatus for making a nonwoven fabric.
Figure 5A:
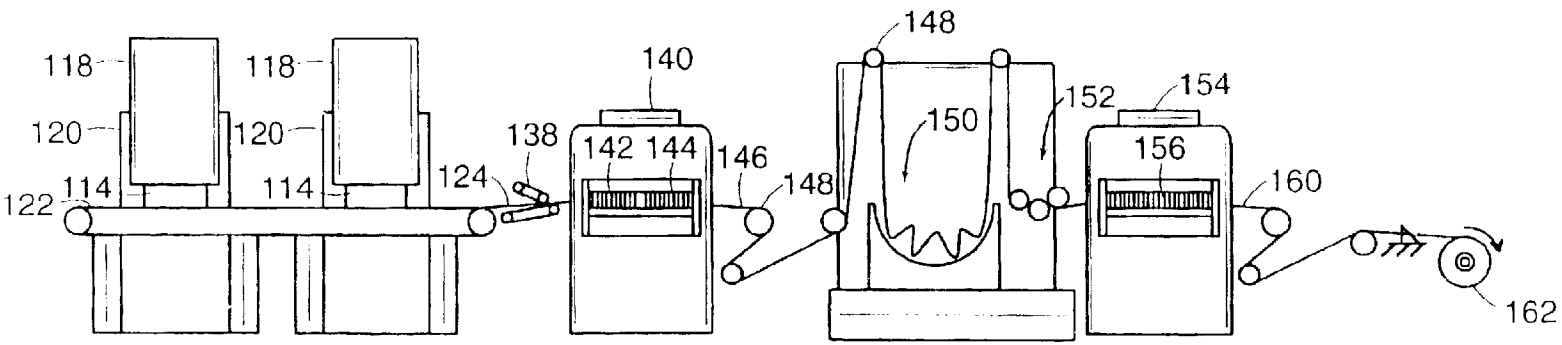
FIG. 5A is a side elevational view of the apparatus of FIG. 5.

FIGS. 5 and 5A illustrate one apparatus and method for producing the above-described loop material. The apparatus includes a feeder 110 (with, e.g., bale breakers, blender boxes or feed boxes), which feeds staple fibers of a desired length of drawn fibers to carding machines 112. The carding machines 112 card the staple fibers to produce carded webs of fibers 114 which are picked up by the take-off aprons 116 of cross-lappers 120. The cross-lappers 120 also have lapper aprons 118 which traverse a floor apron 122 in a reciprocating motion. The cross-lappers lay carded webs 114 of, for example, about 12 to 18 inches (30 to 45 cm) width and about one inch (2.5 cm) thickness on the floor apron 122, to build up several thicknesses of criss-crossed web to form a batt 124 of, for instance, about 90 to 120 inches (2.3 to 3.0 m) in width and about 4 inches (10 cm) in thickness. During carding, the material is stretched and pulled into a cloth-like mat consisting primarily of parallel fibers. With nearly all of its fibers extending in the carding direction, the mat has some strength when pulled in the carding direction but almost no strength when pulled in the carding cross direction, as cross direction strength results only from a few entanglements between fibers. It is important to note that the carding direction is not the machine direction of the finished product. During crosslapping, the carded fiber mat is laid in an overlapping zigzag pattern, creating batt 124 of multiple layers of alternating diagonal fibers. The diagonal layers, which extend in the carding cross direction, extend more across apron 122 than they extend along its length. For instance, we have used batt which has been crosslapped to form layers extending at anywhere from about 6 to 18 degrees from the cross direction of the finished product. The resultant crosslapped batt 124, therefore, has more cross direction strength (i.e., across apron 122) than it has machine direction strength (i.e., along apron 122). Note that the machine direction of the final product is in the same sense as the direction along apron 122. Batt 124 has little machine direction strength because the fiber layers are merely laid upon one another and are in no way woven together. The material properties and the manufacturing process can be affected by the crosslapping angle. A steeper angle may balance the cross and machine direction strengths, which may affect fastener performance and the ease of manufacturing. With more machine-directional crosslapping, in some cases the initial machine direction stretch described below may be eliminated while still obtaining a useful product.

In preparation for needling, batt 124 is gradually compressed in a tapered nip between floor apron 122 and a moving overhead apron 138 to reduce its thickness to about one inch. A relatively thin, low density batt can thus be produced.

Needling of batt 124 is performed in multiple, sequential needling stages in order to provide a very high density of needle penetrations without destroying the low density batt. In the presently preferred method felting needles are employed having fiber-engaging barbs on their sides. Needle punching gives the batt cohesion. The needle barbs pull fibers from one layer of the batt through other layers, entangling the fibers from different layers that are oriented in different directions. The resulting entanglements hold the batt together.

From floor apron 122, the batt is passed to a first needle loom 140 with two needling stations 142 and 144 having rows of notched (i.e., barbed) needles. Needling station 142 needles the batt of staple fibers from its upper surface at a density in the range of 100 to 160 punches per square inch (15 to 25 per square cm). In this embodiment, the batt was needled at a density of 134 punches per square inch (21 per square cm). Subsequently, needling station 144 needles the once-needled batt a second time, with needles that penetrate the batt from its upper surface at a density in the range of 500 to 900 punches per square inch (78 to 140 per square cm) to produce a needled batt 146. In this example, the second needling is at a density of 716 punches per square inch (111 per square cm). We refer to the operation of loom 140 as the first needling stage. Additional information on needling processes can be obtained from the Association of the Nonwoven Fabrics Industry (INDA) of Cary, N.C., which publishes the INDA
Nonwovens Handbook After the first needling stage, needled batt 146 is passed between drive rolls 148 and into a J-box accumulator 150 which, besides holding a bank of batt to accommodate variations in processing rates, allows the needled batt to relax and cool before entering the second needling stage. Alternatively, the needled batt 146 may be spooled after the first needling stage, with subsequent operations performed on a second line. If materials and conditions allow, the needled batt may be passed directly from the first needling stage to the second needling stage without accumulation, but care should be taken to ensure that the batt is sufficiently cool and relaxed to withstand the second needling stage.

As a result of the needle punching, the fibers of the batt become highly randomized and chaotic. However, the underlying pattern of alternating diagonals remains unchanged, although obscured.

From J-box accumulator 150, needled batt 146 is pulled through a guider/spreader 152 (of, e.g., the one-over-two configuration) to properly apply light tension to the batt as is customary for needling, without significant stretching of the batt. It then passes through a second needle loom 154 for a second needling stage. The operation of this second stage is referred to "super needling", as it is a very dense secondary needling operation and produces many loops of substantial loft. Loom 154 has a single needling station 156 in which needled batt 146 is needled from the lower side to produce high-loft loops extending from the upper side. To produce such loops, the sharp tips of the notched needles of loom 154 are extended a substantial distance (e.g., about ¼ inch or 6.3 mm) beyond the thickness of the batt in the opposite direction as the needles of the first needling station, pushing individual fibers away from the bulk of the batt to form upstanding loops. When the needles retract, the loops remain. The loops may be formed of fibers that originally lay on the opposite side of the batt, or from fibers drawn from the middle of the batt. In either case, the needles drag fibers out of the batt and leave them extending from the bulk of the batt as loops which give one side of the super-needled batt a fuzzy appearance.

This super-needling process does not require special needling bedplates or supporting brushes into which the needles extend, such as are employed in structured or random velour looms, although such techniques may be employed to advantage, e.g., where large loops are desired for use with large hooks. The super-needling is primarily characterized as an extremely dense needling, on the order of about 1000 to 2000 punches per square inch (155 to 310 per square cm), or preferably about 1400 punches per square inch (217 per square cm). Standard barbed needles are employed, such as triangular section 15×18×42×3 C222 G3017 felting needles from Groz-Beckert. During this secondary needling operation, individual fibers of the batt are pushed through the loop side of the batt to produce loose, relatively lofty loops. Together, these loops give the loop side of the super-needled batt a fuzzy appearance and feel. Too much extension of the individual loop fibers at this point can cause them to break during subsequent stretching, so the distance the needles extend through the batt is selected in consideration of the denier and tenacity of the fibers used. We have found that extending the needles about ¼ inch (6.3 mm) beyond the batt works well for 6 denier fibers with a tenacity of about 3.5 grams per denier.

Needle loom 154 may include an additional, second needling station (not shown). After producing high-loft loops extending from one surface, the batt is super needled in the other direction to produce loops extending from its other surface, such that both sides have extended loops.

After leaving loom 154, super-needled batt 160 is split into two running 45 inch (114 cm) widths and spooled on rolls 162. As shown in FIG. 11, the fibers of batt 160 have been entangled by the needle punching process to create loose entanglements throughout the batt. At this stage, the batt is not an acceptable loop product for many hook-and-loop fastening applications, as the individual loops may be relatively easily pulled away from the batt and are not well anchored at the entanglements.

Other suitable needling techniques are described in WO 99/11452.

The batt following super needling has a fair amount of loft and resiliency, with the loops and other fibers of the batt forming loose, gentle arches between entanglements. At this point the batt is very flexible, and the density of fibers gradually decreases away from either side of the material. At first glance, it can be difficult to tell which side has been super-needled, if only one side has been subjected to that action. Batt 160, in this example, has an overall thickness, including loops, of about 3/16 inch (4.8 mm) and a weight of between about 2 and 4 ounces per square yard (68 and 135 grams per square meter).

Figure 6:
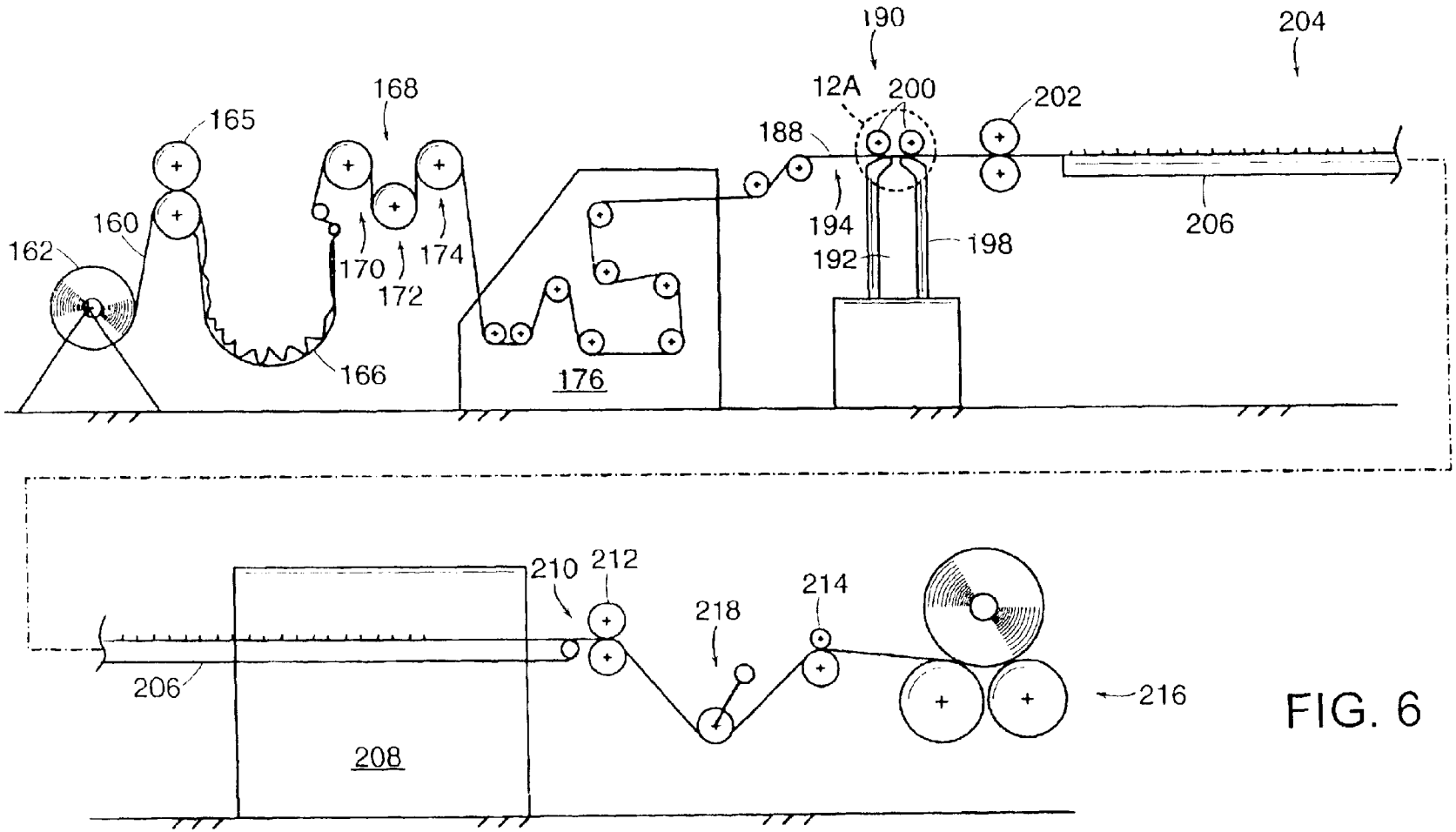
FIG. 6 is a schematic view of an apparatus for stretching and stabilizing a nonwoven material.

Referring to FIG. 6, a spooled length of super-needled batt 160 is spooled from roll 162 by drive rolls 165 and into a J-box accumulator 166, allowing roll 162 to be replaced and the batt spliced without interrupting further processes. The J-box also allows the batt to recover from any elastic deformation caused by the spooling process. Batt 160 is pulled from accumulator 166 through a guider 168 to center the batt in the cross-machine direction. Guider 168 includes three rolls in a two-over-one configuration. The first and second rolls 170 and 172 have left and right herringbone pattern scroll surfaces originating at the center of the roll that, being slightly overdriven, urge any wrinkles in the batt toward its edges to remove them. The third roll, roll 174, is a split braking roll to controllably tension either half of the batt to guide the fabric to the left or right as desired.

From guider 168 the batt passes through a tension controller 176 that maintains a desired tension in the batt through the subsequent binder application process. Controlling the difference between the speed of tension controller 176 and downstream drive rolls 202 applies a desired amount of machine direction stretch to the batt prior to cross-machine stretching. In some cases, no substantial machine direction stretch is purposefully applied, any noted machine direction lengthening being due only to minimal web processing tension in the supply batt. In other cases, machine direction stretch is purposefully induced by running drive rolls 202 faster than tension controller 176.

In the embodiment in which batt 160 has been superneedled to produce loops extending from only its front side 188, batt 160 is next passed through a coating station 190 in which a foamed, water-based adhesive 192 (i.e., a water-based adhesive, whipped to entrain air) is applied to the back side 194 of the batt across its width.

Figure 6B:
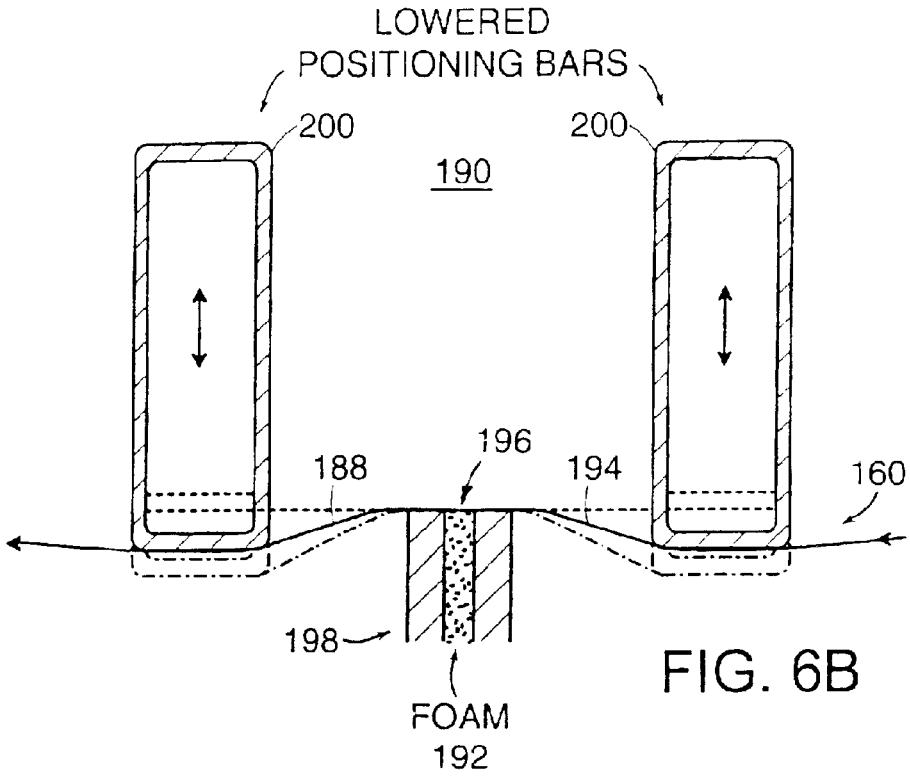
FIGS. 6A and 6B are enlarged views of area 6A in FIG. 6 under two different conditions of operation.
Figure 6A:
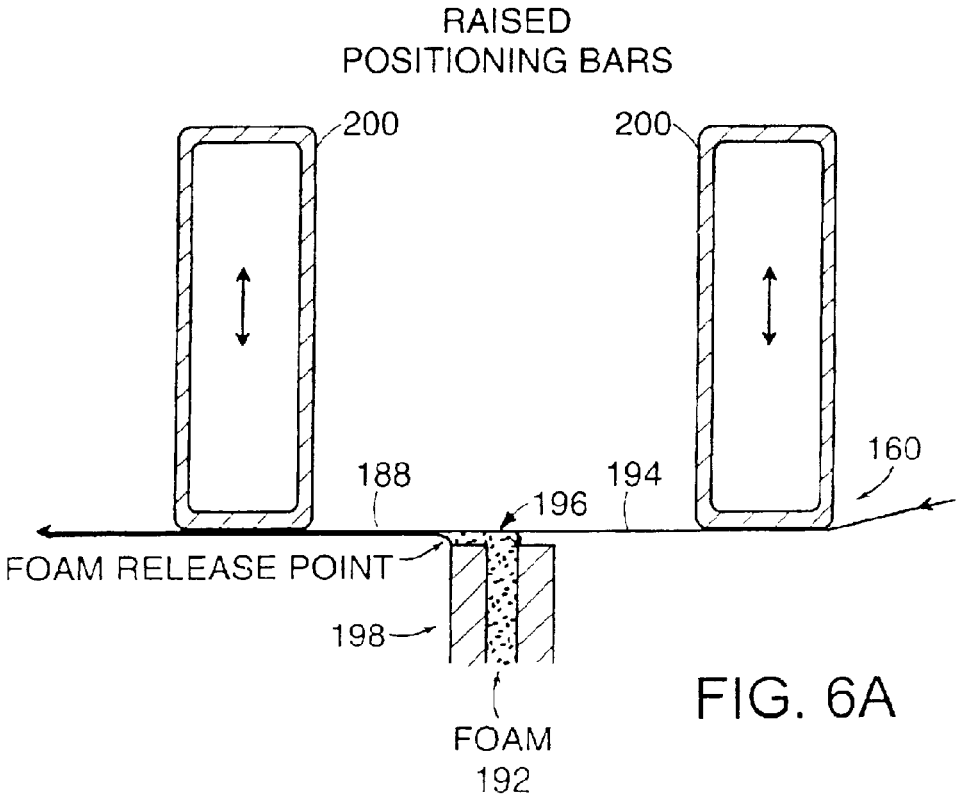

Referring also to FIGS. 6A and 6B, the foamed liquid adhesive is pumped at a controlled rate through a long, narrow aperture 196 in the upper, surface of the applicator 198 as the batt is wiped across the aperture, thereby causing the adhesive to partially penetrate the thickness of the batt. Positioning bars 200, on either side of aperture 196, are raised (FIG. 6A) and lowered (FIG. 6B) to control the amount of pressure between batt 160 and applicator 198. The depth of penetration of the adhesive into the batt is controlled (e.g., by the flow rate and consistency of adhesive 192, the speed of batt 160 and the position of bars 200) to sufficiently coat or penetrate enough of the fiber entanglements to hold the product in its final form, while avoiding the application of adhesive 192 to the loop-forming fiber portions of the front side 188 of the batt. The foaming of the liquid adhesive before application helps to produce an even coating of the back side of the batt and helps to limit penetration of the fluid adhesive into the batt. After the semi-stable foam is applied it has a consistency similar to heavy cream, but the bubbles quickly burst to leave a liquid coating that flows as a result of wetting and surface tension, into the tightening fiber entanglements.

Alternatively, the foam may have a thicker consistency, more like shaving cream, to further reduce the penetration into the batt and form more of a distinct resinous backing. A non-collapsible (i.e., stable) foam of urethane or acrylic, for instance, is useful to produce a radio frequency-weldable backing which functions as a water barrier. Such a product has particular application to disposable garments and diapers.

The stable foam backing also reduces the air permeability of the web, which facilitates vacuum transfer. Vacuum transfer may be used advantageously to apply the closure to a finished product, e.g., a diaper tab to a diaper.

Also, because the stable foam layer reduces the permeability of the web, the web generally has a more substantial appearance, and greater opacity. If desired, the stable foam coating can include a colorant, to provide the finished product with an aesthetic color. The stable foam layer also enhances the printability of the loop material, by providing a more opaque background and a relatively continuous ink-receptive surface. Printing may be performed on either the loop-carrying side of the loop material or the back of the stable foam layer, with good results. Thus, the loop material may be printed with decorative designs, product information, or an optically scannable image such as a bar code.

In addition, the stable foam layer provides a surface to which adhesive can be applied, to adhere the finished product to a desired substrate or object. If desired, the permeability of the stable foam layer can be adjusted so that there will be minimal or no penetration of adhesive through the stable foam layer into the loop-carrying portion of the finished product. In applications in which a purchaser of the loop material will apply an adhesive to the material, the presence of a stable foam layer facilitates application of the adhesive by minimizing the need for the purchaser to adjust his process to prevent adhesive strike-through.

A suitable applicator for applying a stable foam to the web is commercially available from Gaston County Environmental Systems, Stanley, N.C., under the tradename "GASTON COUNTY CFS". Suitable polymers for use as stable foams include textile polymers such as those commercially available from B. F. Goodrich under the tradenames HYCAR, HYSTRETCH, VYCAR and SANCURE. The use of a stable foam in such an applicator allows a very thin layer of a coating to be applied with a uniform, consistent thickness.

Generally, the wet (as applied) thickness of the foam is from about 0.015 inch to 0.250 inch, and the dry (final) thickness of the foam is from about 0.125 inch to 0.315 inch. The amount that the thickness will change during drying will depend on the wet thickness, with thicker coatings experiencing greater changes in thickness. The shrinkage in the coating is predominantly caused by breaking of the foam bubbles. The degree to which the bubbles break during drying will depend on a number of factors, including surface tension and the size and number of bubbles. If thicker coatings are desired, a bubble stabilizer can be added, to reduce breakage of the bubbles.

It is important that the binder (e.g., adhesive 192) not interfere with the loop-forming portions of the fibers on the front side 188 of the batt. It is not necessary that the knot bases be completely covered by binder; it is sufficient that they be secured by the binder in the finished product to stabilize the fabric against significant further stretching and to strengthen the bases of the loops. Preferably, the binder is at least partially in liquid form to wick into the entanglements before and while they are subsequently tightened during stretching. The capillary action of the liquid binder is such that examination of the finished product shows that the binder is almost exclusively at the knots of the web (at the base of the loops, for instance), and therefore does not tend to adversely affect either the functionality of the free-standing loops or the flexibility of the web.

After leaving coating station 190, the material is subjected to stretching in the plane of the web. In the presently preferred case the web is wound through variable speed drive rolls 202 and onto a tenter frame 204 for cross-machine stretching (i.e., stretching in the cross-machine direction). The speed of drive rolls 202 is adjustable, with respect to both tension control 176 and the rails 206 of the tenter frame, to cause a predetermined amount of machine direction stretch in the batt, either between tension control 176 and drive rolls 202, or between drive rolls 202 and frame rails 206, or both. In some embodiments no permanent machine direction stretch is applied, but the batt is nevertheless held in tension to control adhesive penetration and maintain proper frame rail pin spacing. In other embodiments the batt is generally stretched, in total, between about 20 percent and 50 percent in the machine direction before tentering.

As it enters tenter frame 204, the 45 inch wide batt 160 is engaged along its edges by pins of frame rails 206 that maintain the machine-direction dimension of the material as it is stretched in the cross-machine direction. The spacing (of, e.g., about 3/16 inch or 4.8 mm) between adjacent pins is maintained throughout the length of the tenter frame, such that no additional machine-direction stretch is applied. Due to the needling, batt 160 should have enough tensile strength to be properly engaged by the rail pins and withstand the subsequent cross-machine stretching.

Tenter frame 204 has a tapered section where the rails 206 separate at a constant, adjustable range rate over a machine-direction length of about 10 feet (3 meters) to a final width, which can range from 45 inches (114 cm) to about 65 to 69 inches (165 to 175 cm). This equates to a cross-machine stretch, in this particular embodiment, of about 50 percent. In general, to take advantage of the economics that can be realized according to the invention, the batt should be stretched to increase its area by at least about 20 percent (we call this "percent areal stretch"), preferably more than about 60 percent areal stretch and more preferably more than about 100 percent areal stretch, to increase the area of the product while tightening the binder-containing entanglements of the batt that contribute to improvement in the strength of anchorage of the individual loops. We have found that in some cases the super-needled batt can be stretched, by employing the above method, at least 130 areal percent or more and provide very useful hook-engaging properties. The more the stretch, the greater the overall yield and the lighter in weight the final product. Even greater overall cross-machine stretch percentages can be employed, for instance by using multiple tentering stages in situations wherein the batt is constructed to withstand the stretch and still be able to reasonably engage hooks. In one instance, the super-needled batt described above was stretched from an initial width of 45 inches (114 cm) to 65 inches (165 cm), softened (by adding a softener), slit to a 45 inch (114 cm) width, stretched a second time to a 65 inch (165 cm) width before applying a binder, and still had useful, hook-engageable loops. In some cases final product widths of 6 to 8 feet (1.8 to 2.4 meters) or even much more can be achieved.

In one embodiment, the non-woven web starting material used to manufacture the loop component is a fairly dense, needle punched, non-woven web of fibers lying in an apparently chaotic and tangled manner. One side, the "fuzzy side", has an excess of large, loose loop fibers created during a second needle punching process. The web is first stretched to 130 percent of its initial length in the machine direction. This stretching results in necking—the material narrows to 80 percent of its initial width, from 45 inches (114 cm) to 36 inches (91 cm). It is then coated with a binder. Next, it is stretched to 175% of its necked width, from 36 inches (91 cm) to 63 inches (160 cm). During this process the material becomes much more sparse, with spider-like clusters of fiber (see bases B of FIG. 2) serving to anchor the loop. The mechanism by which this change occurs relates to the method by which the initial/non-woven web is manufactured.

The amount of needling, the starting basis weight, and the stretchability of the batt are all related. Within a range of basis weight and needling density useful for creating a stretchable web, increasing either the basis weight of the starting batt or the needling density will decrease the amount of stretch that can be applied to the needled batt. As is known in the art, there is a minimum basis weight required for effective needling, below which an insufficient number of entanglements will be formed by the needling to produce a coherent web which can be handled without falling apart. At the other end of the spectrum, too high of a basis weight can result in needle breakage and/or fiber breakage during needling. To produce the very light, thin loop material enabled by the invention, the basis weight of the starting batt and the needling density should be selected to permit a fair amount of stretch of the needled material, as it is the stretching that thins the needled product and increases its yield. In other words, if the needled product is to be stretched, the needling process should leave a substantial proportion of the base fibers slack, and their entanglements loose.

The denier of the fibers used may also affect stretchability in the cross-machine direction. Generally, if the variables discussed above are kept constant, as denier decreases stretchability in the cross-machine direction will also tend to decrease. Generally, this tendency may be offset by changing the basis weight and/or needling density as discussed above.

The "loop trees" (see FIG. 3), which do not distinctly appear in the pre-stretched batt, obtain their final form as fibers of the ground portion of the web are pulled and the entanglements beneath them are tightened during stretching to form knots. As the batt is stretched, the tension in the taut fibers of the web forces some of the loop trees to stand erect, such that the overall thickness of the stretched batt (with functional loops) can actually be greater than the unstretched batt. To extend the horticultural analogy, the homogeneous thicket of the loop surface of the unstretched batt becomes the orchard of spaced clusters of the stretched product. Although the loop trees or loop formations correspond to locations where the batt was punched during super-needling, the resulting "orchard" of loop formations does not exhibit the same ordered pattern, after the web is stretched, as might be anticipated by the pattern of punches of the needling process. We believe that the arrangement of loop formations is randomized during the stretching process, as distances between entanglements change as a function of the properties, direction and number of the fibers connecting various nodes. The resulting product has no apparent order to the arrangement of loops extending from its surface.

Despite the relatively wide loop spacing that is achieved, the loops, after curing of the binder, are found to be so strongly anchored and so available for engagement by the hooks, that a web unusually treated according to these techniques can perform in an excellent manner despite having a gossamer appearance.

Referring back to FIG. 6, while the stretched batt is held on frame rails 206 in its stretched condition it is passed through an oven 208 in which the product is heated to dry and cross-link acrylic binder 192 and stabilize the dimensional integrity of the batt. Oven 208 is essentially a convection drier with air venturi nozzles which blow hot air up into and down onto the web to evaporate some of the water of the adhesive. In this example, the heating time and temperature are about one minute and 375 degrees F. (190 degrees C.), respectively. In some embodiments (not shown), the batt is retained on frame rails 206 for secondary coating passes through additional coating stations and drying ovens, thereby building up a desired laminate structure for particular applications.

In another embodiment, hook-engageable loops are formed on both sides of the web by needling, by the super-needling techniques acting on staple fibers that have been described, or by other known techniques. After forming the loops the web is passed through a bath of binder. In some cases, where the loops are relatively stiff and the binder is of suitably low viscosity, after removal from the bath the binder drains from the loops and the loops, by their own resiliency and stiffness resume their free-standing stance while capillary action retain the binder in the center of the fabric. The web is then subjected to stretching and curing as above.

In other instances, as where the loop material is less stiff, auxiliary means are employed to remove excess binder after passing through the bath, as by passing the fabric through a nip of squeeze rolls, or by subjecting both sides of the fabric to an air knife, or by blotting followed, in each case for instance by blowing air or otherwise loosening the loops and causing them to stand upright.

Other embodiments carrying hook-engageable loops on one or both sides, and incorporating heat-fusible binder fibers or other heat-fusible binding constituents, are bonded by non-contact means such as by blasts of hot air directed at both sides of the fabric at temperatures sufficient to melt the heat-fusible binding material and lock the fabric structure in its stretched condition.

Heat fusible fibers or other material colored black or otherwise adapted to absorb radiant heat, may be activated by radiant heaters to bind the ground portion of the fabric following stretching. Care must be taken, in such instances, to avoid mitigation of the engagement properties of the free-standing loops.

Referring back to FIG. 6, the stretched batt exits oven 208 still attached to the pins, and is then pulled from the pins by a de-pinning device 210 and a pair of drive rolls 212. The finished, wide batt is then slit, if desired, into appropriate multiple widths by a slitter 214 and spooled on a driven surface winder 216. A dancer 218 between drive rolls 212 and slitter 214 monitors the tension in the batt to control the speed of winder 216. Slitter 214 can also be used to trim off the edges of the batt that include the material outboard of the frame rails through the tenter frame. Optionally, the finished batt can be brushed before or after spooling to disentangle loosely-held loop fibers to improve the consistency of the closure performance between the first and subsequent engagements with a hook product.

Alternatively, heated rolls, "hot cans" or platens may be employed to stabilize the back side of the fabric in its stretched condition. This embodiment does not require a coating or adhesive when using thermoplastic fibers, as the fibers are locally fused together by heat. Cooled rolls engage the loop side of the fabric during stabilization, to prevent damage to the hook-engageable loops.

It will be understood that the above-described stretching technique can be employed to advantage on other stretchable, loop-defining non-woven webs. Thus, in its broadest aspects, the invention is not to be limited to the use of needled webs. Webs formed by hydro or air current entanglement can, for instance, be employed.

In most cases where significant strength performance is desired, it is preferable to employ non-woven materials formed of staple fibers to take advantage of their drawn, molecular oriented structure, or other fibers of the substantial tenacity. We have found that loops formed of crimped staple fibers work particularly well, as the crimps of the fibers help to hold the loops apart from each other and exposed for engagement, as well as permitting greater hook penetration of the "forest" of loop structures. The crimps can also assist in the formation of the loop structures, as they form snag points for enhancing the entangling of the base fibers.

Inter-fiber friction is known to be important for efficient needling. Because of its higher friction, polyester is considered to be a better fiber material for needling than polyethylene, even though polyethylene can provide a better hand for some applications. For products tightened by stretching rather than hyper-needling, however, lower needling efficiencies can be tolerated, enabling the use of low-friction, good hand materials like polyethylene.

Besides being useful for loop-forming fibers, crimped or variable thickness fibers are also useful for forming the stretched base web. The crimps or thickness variations help to entangle base fibers as they slide against one another during tightening. As known in the art of needling, crimps can also improve needling efficiency. A spun fiber can be effectively "crimped" by subjecting the spun fiber as it leaves its nozzle to a series of transverse air blasts from one or more directions. An hourglass thickness variation can be produced in spun fibers by modulating the ambient air pressure just outside the opening of the nozzle.

As mentioned above, in certain applications the stretched is advantageously secured to a supporting material in its stretched condition.

The complete disclosures of U.S. patent application Ser. No. 09/262,159, filed Mar. 3, 1999, and U.S. patent application Ser. No. 08/922,292, filed Sep. 3, 1997 are incorporated herein by reference.

Other embodiments are within the scope of the following claims. For example, rather than using a liquid adhesive or foam as a binder, as discussed above, the web may be stabilized by applying a polymer film to the web, e.g., by lamination or extrusion.

Figure 7:
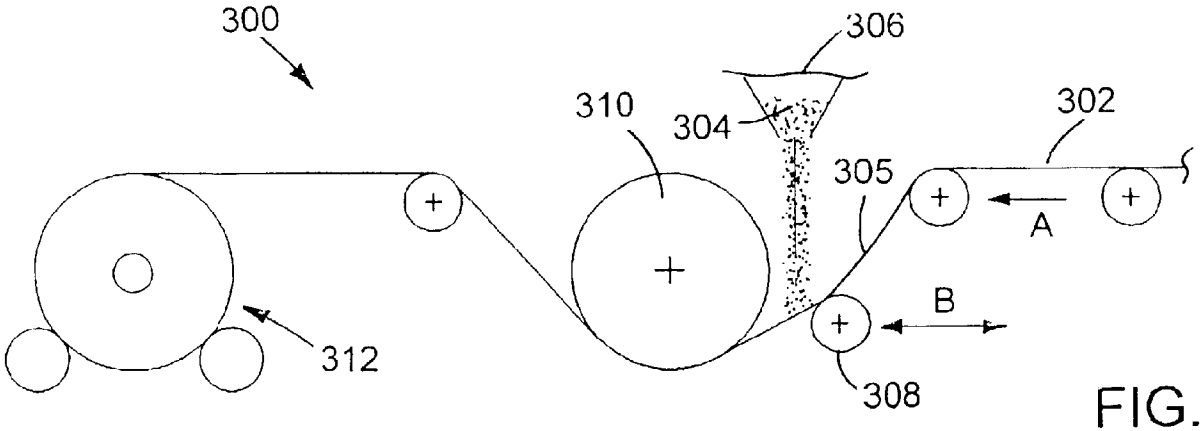
FIG. 7 is a diagrammatic view of an apparatus for applying a film to a stretched nonwoven material.

A standard packaging film extruding process (slot die process) can easily be adapted so that the film-extruding die directly coats a surface of the web to stabilize the web. For example, as shown in FIG. 7, on a process line 300 a web of loop material 302 travels in the direction of arrow A. A polymer 304 is curtain coated onto the surface 305 of the loop material 302 by a film extruder 306 having a full width slot die. The molten polymer cascades down into a nip formed between the surface 305 of the web and a cooling roll 310. The molten polymer bonds to surface 305, either by encapsulation or thermal effect. Calendar pressure can be applied by a nip pressure roller 308 on the opposite (loop-carrying) side of the web of loop material, to further integrate and/or texture the coating layer. The nip pressure roller 308 may be moved in the direction indicated by arrow B to adjust the final properties of the coated web. After passing through the nip, the coated web is rolled up on take-up roller 312.

A suitable lamination process includes directing a pre-formed resin film along side and parallel to the back side (the non-loop-carrying side) of a web of loop material. The film and web are then run through a hot can nip process which melts the resin film directly onto the back surface of the loop material.

In addition to stabilizing the web, the polymer film can be selected to also act as a bonding layer, allowing the loop material to be easily bonded to a substrate. Thus, the film may be used as a tie layer, which enhances the adhesion between two dissimilar surfaces, for example adhesion of nylon or polyester fibers in the non-woven web to a polyethylene substrate, e.g., a polyethylene bag.

The film may be non-porous, to facilitate vacuum transfer and/or provide barrier properties, or can be porous if desired. The film may be printed or embossed after it is applied, and may be used to provide features such as tagging or anti-theft circuitry. The film may be as thin as 0.001" if desired. This process can also be used to apply a polymer film to other types of nonwoven loop materials, as well as the loop materials described above.

What is claimed is:

1. A loop product for hook-and-loop fastening, the loop product comprising a non-woven web of entangled fibers, the fibers forming a sheet-form web body stabilized in a condition of at least about 20 percent areal stretch, in which hook-engageable loops extend in clusters from tightened entanglements within the web body, the entanglements being joined together by straightened fibers, the product having a basis weight of less than about 4 ounces per square yard wherein the fibers comprise a blend of relatively higher denier fibers and relatively lower denier fibers.

2. The loop product of claim 1 wherein the relatively higher denier fibers have a fiber denier of 6 or greater and the relatively lower denier fibers have a fiber denier of less than 6.

3. The loop product of claim 1 wherein the relatively lower denier fibers have a fiber denier of 3 or less.

4. The loop product of claim 3 wherein the relatively lower denier fibers have a fiber denier of 1.5 or less.

5. The loop product of claim 1 wherein the relatively higher denier fibers have a denier of from 2.5 to 3.5 and the relatively lower denier fibers have a denier of from about 1.0 to 2.0.

6. The loop product of claim 1 wherein the web body is stabilized in a condition of at least 10 percent stretch in each of two perpendicular directions.

7. The loop product of claim 6 in which the web body is stabilized in a condition of at least 25 percent stretch in each of two perpendicular directions.

8. The loop product of claim 1 wherein the tightened entanglements are present in a density of between about 50 and 1000 entanglements per square inch of web body.

9. The loop product of claim 1 wherein the fibers have a tenacity of at least 2.8 grams per denier.

10. The loop product of claim 9 wherein the fibers have a tenacity of at least 5 grams per denier.

11. The loop product of claim 10 wherein the fibers have a tenacity of at least 8 grams per denier.

12. The loop product of claim 1 wherein the fibers are of a material selected from the group consisting of polyester, polyurethane, polypropylene polyethylene, nylon, homopolymers, mixtures, copolymers, alloys, or coextrusions thereof, natural fibers, and blends thereof.

13. The loop product of claim 12 wherein the fibers are polyester.

14. The loop product of claim 12 wherein the fibers are polypropylene.

15. The loop product of claim 12 wherein the fibers are a blend of polyester and polypropylene.

16. The loop product of claim 1 having a Gurley stiffness of less than about 300 milligrams.

17. The loop product of claim 1 comprising polymer filaments entangled among said fibers, said filaments being at least partially melted to bond the web body.

18. The loop product of claim 1 in which said fibers comprise bicomponent fibers prior to stabilization of the web, the bicomponent fibers including a first polymer that melts during stabilization to provide a stabilizing binder, and a second polymer that does not melt during stabilization.

19. The loop product of claim 1 having a basis weight of less than about 2 ounces per square yard.

20. The loop product of claim 1 in which the nonwoven web is stabilized in its stretched state by material adhered to a back surface of the web.

21. The loop product of claim 20 in which said material comprises a solidified binder material.

22. The loop product of claim 1 in which the nonwoven web is stabilized in its said stretched state by solidified fibers of low melt polymer.

23. The loop product of claim 21 in which the binder material comprises a backing.

24. The loop product of claim 21 in which the binder material comprises an impermeable barrier.

25. The loop product of claim 21 wherein the binder forms a water-resistant layer.

26. The loop product of claim 21 wherein the binder includes a fire-retardant material.

27. The loop product of claim 1 further comprising a layer adhered to a surface of said nonwoven web opposite the surface from which the loops extend.

28. The loop product of claim 27 in which said layer comprises a supporting fabric.

29. The loop product of claim 1 further comprising a carrier layer laminated to a surface of said nonwoven web opposite the surface from which the loops extend.

30. The loop product of claim 29 in which said carrier layer comprises a film.

31. The loop product of claims 29 or 30 in which said nonwoven web is laminated to one side of the carrier layer, and the opposite side of the carrier layer is provided with a layer of pressure-sensitive adhesive for application to a surface.

32. The loop product of claim 1 further comprising a resilient layer of foam disposed on a surface of the non-woven web opposite the surface from which the loops extend.

33. The loop product of claim 1 or 32 further comprising an optically scannable image printed on the loop-carrying surface of the non-woven web.

34. The loop product of claim 1 further comprising a layer of resin disposed on a surface of the non-woven web opposite the surface from which the loops extend.

35. The loop product of claim 34 in which the resin layer includes hook projections shaped to engage the hook-engageable loops.

36. A loop product for hook-and-loop fastening, the loop product comprising a non-woven web of entangled fibers, the fibers forming a sheet-form web body stabilized in a condition of at least about 20 percent areal stretch, in which hook-engageable loops extend in clusters from tightened entanglements within the web body, the entanglements being joined together by straightened fibers, the product having a basis weight of less than about 4 ounces per square yard and at least some of the fibers having a fiber denier of less than 3.

37. The loop product of claim 36 wherein the majority of the fibers have a fiber denier of less than 3.

38. The loop product of claim 36 wherein at least some of the fibers have a fiber denier of 1.5 or less.

39. A substrate comprising a surface layer of thermoplastic material, and the loop product of claim 1, wherein at least some of the fibers of the non-woven web on a surface of the non-woven web opposite the hook-engageable loops are encapsulated within the layer of thermoplastic material.

40. A loop product for hook-and-loop fastening, the loop product comprising a non-woven web of entangled fibers, the fibers forming a sheet-form web body stabilized with binder in a condition of at least about 20 percent areal stretch, in which hook-engageable loops extend in clusters from tightened entanglements within the web body, the entanglements being joined together by straightened fibers, the product having a basis weight of less than about 4 ounces per square yard, said fibers comprising bicomponent fibers prior to stabilization of the web, the bicomponent fibers including a first polymer that melts during stabilization to provide said binder, and a second polymer that does not melt during stabilization.

41. A loop product for hook-and-loop fastening, the loop product comprising a non-woven web of entangled fibers, the fibers forming a sheet-form web body stabilized with binder in a condition of at least about 20 percent areal stretch, in which hook-engageable loops extend in clusters from tightened entanglements within the web body, the entanglements being joined together by straightened fibers, the product having a basis weight of less than about 4 ounces per square yard, wherein said binder comprises a stable foam coating.

42. A loop product for hook-and-loop fastening, the loop product comprising a non-woven web of entangled fibers, the fibers forming a sheet-form web body stabilized with binder in a condition of at least about 20 percent areal stretch, in which hook-engageable loops extend in clusters from tightened entanglements within the web body, the entanglements being joined together by straightened fibers, the product having a basis weight of less than about 4 ounces per square yard, wherein said binder comprises a polymer film.

43. A loop product for hook-and-loop fastening, the loop product comprising a non-woven web of entangled fibers, the fibers forming a sheet-form web body stabilized with binder in a condition of at least about 20 percent areal stretch, in which hook-engageable loops extend in clusters from tightened entanglements within the web body, the entanglements being joined together by straightened fibers, and a foam layer disposed on a surface of the non-woven web opposite the surface from which the hook-engageable loops extend.

44. The loop product of claim 43 further comprising an optically scannable image printed on the surface from which the hook-engageable loops extend.

45. The loop product of claim 43 wherein said stable foam is water resistant.

46. The loop product of claim 43 further comprising a layer of adhesive disposed on an exposed surface of the layer of stable foam.

47. A loop product for hook-and-loop fastening, the loop product comprising a non-woven web of entangled fibers, the fibers forming a sheet-form web body stabilized with binder in a condition of at least about 20 percent areal stretch, in which hook-engageable loops extend in clusters from tightened entanglements within the web body, the entanglements being joined together by straightened fibers, and an optically scannable image printed on a surface of the non-woven web from which the hook-engageable loops extend.

* * * * *